US008496313B2

(12) United States Patent
Ueshima

(10) Patent No.: US 8,496,313 B2
(45) Date of Patent: Jul. 30, 2013

(54) IMAGE PROCESSING METHOD, IMAGE PROCESSING APPARATUS, INKJET IMAGE FORMING APPARATUS AND CORRECTION COEFFICIENT DATA GENERATING METHOD

(75) Inventor: Masashi Ueshima, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 319 days.

(21) Appl. No.: 13/070,936

(22) Filed: Mar. 24, 2011

(65) Prior Publication Data

US 2011/0234673 A1 Sep. 29, 2011

(30) Foreign Application Priority Data

Mar. 25, 2010 (JP) ..... 2010-070289

(51) Int. Cl.
*B41J 29/38* (2006.01)

(52) U.S. Cl.
USPC ..... 347/14; 347/12; 347/13; 347/19; 347/23; 347/42

(58) Field of Classification Search
None
See application file for complete search history.

(56) References Cited

U.S. PATENT DOCUMENTS

2007/0132804 A1 6/2007 Chiwata

FOREIGN PATENT DOCUMENTS

JP 2007-160748 A 6/2007

*Primary Examiner* — Stephen Meier
*Assistant Examiner* — Tracey McMillion
(74) *Attorney, Agent, or Firm* — Birch, Stewart, Kolasch & Birch, LLP.

(57) ABSTRACT

An image processing method of creating image data for forming an image on a recording medium by ejecting liquid droplets from a plurality of nozzles of a recording head onto the recording medium while causing relative movement of the recording medium and the recording head, includes: a correction coefficient storage step of determining correction coefficients for ejection failure correction based on difference of landing interference patterns of a plurality of types, and storing the correction coefficients for ejection failure correction according to the landing interference patterns, in a storage unit; an ejection failure nozzle position information acquisition step of acquiring ejection failure nozzle position information and a correction processing step of performing a correction calculation on input image data using a corresponding correction coefficient obtained by referring to the correction coefficients for ejection failure correction according to the ejection failure nozzle position information.

14 Claims, 16 Drawing Sheets

IMAGE PROCESSING METHOD, IMAGE PROCESSING APPARATUS, INKJET IMAGE FORMING APPARATUS AND CORRECTION COEFFICIENT DATA GENERATING METHOD

BACKGROUND OF THE INVENTION

1. Field of the Invention

The present invention relates to image correction technology for improving image quality declined due to nozzles suffering ejection failure in an inkjet image forming apparatus.

2. Description of the Related Art

In the field of inkjet image formation, various measures are adopted in order to achieve image formation of high resolution by means of an inkjet head; for example, as shown in FIG. 13, a head 300 is constituted by a structure in which a plurality of nozzle head modules 301 are arranged in a staggered configuration, and the recording position pitch Δx on the paper 340 (image receiving medium) is made narrower than the pitch Pm of the nozzles 320 in the head module 301, thereby raising the recording resolution, and so on. In the example in FIG. 13, a head 300 is composed so as to have a nozzle arrangement (staggered arrangement) whereby the recording position pitch Δx on the paper 340 is approximately Pm/2.

By conveying the paper 340 in a substantially perpendicular direction to the lengthwise direction of the head 300 at a uniform speed and controlling the droplet ejection timing of the nozzles 320, it is possible to form a desired image on the paper 340. Here, it is supposed that the paper 340 is conveyed from the lower side toward the upper side in FIG. 13. If the conveyance direction of the paper 340 is the y direction and the width direction of the paper perpendicular to this is the x direction, then it is possible to form dots (recording points formed by depositing liquid droplets) at a pitch of Δx in the x direction on the paper 340. Here, Δx is a value which corresponds to the recording resolution (in the case of 1200 dpi, approximately 21.2 μm).

The alignment sequence of nozzles 320 capable of forming a dot row in the x direction on the paper 340 at a pitch (Δx) corresponding to the recording resolution (the alignment sequence of nozzles obtained by projecting the nozzle arrangement in the head 300 onto the x axis) gives the effective nozzle arrangement. In the present specification, nozzles which are in a mutually adjacent positional relationship in the nozzle alignment sequence of this effective nozzle row (the projected nozzle row on the x axis) are called "adjacent nozzles". In other words, nozzles which are not necessarily in adjacent positions in the nozzle layout in the head 300 but are aligned in adjacent positions when viewed as a projected nozzle row on the x axis of the paper 340, are called "adjacent nozzles".

When an inkjet head of this kind is installed in a printing apparatus, it is necessary to adjust the angle and position of installation of the head, but there are limits on the mechanical adjustment precision. Consequently, there are cases where, as shown in FIG. 14, the head 300 is slightly rotated from the specified position (the ideal installation position according to the design) and where the head 300 is installed on the printing apparatus in a state having a residual amount of rotation (Δθ). Furthermore, there are also cases where, as shown in FIG. 15, the arrangement positions of the head modules 301 are slightly divergent and the head 300 is installed on the printing apparatus in a state having a residual divergence in the arrangement position (Δd). When ink is ejected from the nozzles 320 of the head 300 in a state of this kind, error ("depositing position error") occurs in the depositing positions on the paper 340.

Furthermore, in addition to the problem of depositing position error caused by the adjustment accuracy described above, when starting to use the inkjet head, nozzles which are in a state of ejection failure also arise due to blockages, failures, and the like. In particular, in the case of image formation by a single pass method, the ejection failure nozzle locations are perceived as white stripes and therefore must be corrected. Various different ejection failure correction technologies for improving image defects arising due to ejection failure nozzles of this kind have been proposed in the related art (see, for example, Japanese Patent Application Publication No. 2007-160748). The basic approach to ejection failure correction technology is to improve visibility by adjusting the output image density or the ejected dot size in a plurality of nozzles before and after an ejection failure nozzle.

When general ejection failure correction technology is used in a head having depositing position errors and ejected droplet volume errors, if the same correction coefficient is used for all of the ejection failure nozzles, then correction may be excessive or insufficient, depending on the state of arrangement of the nozzles, and black stripes or white stripes may become visible on the surface of the paper.

FIG. 16 illustrates schematic views of this phenomenon in (a) to (d). Here, as described using FIG. 14, a case is described by way of example in which a head 300 is installed with a residual amount of rotation (Δθ), and an upper-stage nozzle NA_j and a lower-stage nozzle NB_k are ejection failure nozzles which are suffering an ejection failure (see (a) of FIG. 16). In this case, the ejection failure correction technology of the related art corrects the values (image setting values representing density tone graduations) of pixels corresponding to nozzles which are adjacent before and after the ejection failure nozzles (before and after the ejection failure nozzles in the alignment sequence of the effective nozzle row). In (a) to (d) of FIG. 16, the image setting values of the positions corresponding to the adjacent nozzles NB_j−1 and NB_j+1 before and after the ejection failure nozzle NA_j are corrected, and furthermore the image setting values of the positions corresponding to the adjacent nozzles NA_k−1 and NB_k+1 before and after the ejection failure nozzle NB_k are corrected.

(b) of FIG. 16 shows a schematic view of a state where a solid image (uniform density image) having a certain density (tone value) is formed by using a general ejection failure correction technology in the head 300 in (a) of FIG. 16. Since dots cannot be formed at the positions corresponding the ejection failure nozzles NA_j, NB_k on the paper (the positions in the x direction), then the prescribed density cannot be achieved in the corresponding portions of the image. In order to compensate for this, correction is performed to increase the output density of the adjacent nozzles. (c) of FIG. 16 shows the image setting values of the pixels corresponding to respective nozzle positions. In the case of a tone value D1 indicating a density of a solid image, correction is performed to amend the image setting values to a higher value (D2) using a prescribed correction coefficient in positions which correspond to the adjacent nozzles of the ejection failure nozzles.

However, taking a macroscopic view of the output results after correction, the position corresponding to the ejection failure nozzle NA_j on the paper is over-corrected, the output density becomes high and a so-called "black stripe" appears, as shown in (d) of FIG. 16. Furthermore, the position corresponding to the ejection failure nozzle NB_k is under-corrected, the output density is low and a so-called "white stripe" appears.

In respect of phenomena of this kind, Japanese Patent Application Publication No. 2007-160748 seeks to overcome the aforementioned problem by calculating separate correction coefficients for each nozzle from the depositing position error and the ejected droplet volume error. Furthermore, in many methods, the correction performance for each image setting value is raised by preparing a correction coefficient reference table for ejection failure correction (hereinafter, called a "correction LUT") in respect of the image setting value (image density/image tone) with respect to each nozzle.

However, in the ejection failure correction technology of the related art, the physical conditions which are considered in particular as the dominant factors are mainly limited to two items only, namely, the depositing position and the dot diameter (which has a correlation with the volume of the ejection droplet) of the ejected liquid. The image formation process by an inkjet head cannot be described fully on the basis of these two physical conditions alone, and there are also cases where sufficient correction performance is not obtained with related art correction technology which only considers these two items. One example of a dominant factor which is not considered in ejection failure correction technology of the related art is "landing interference". This landing interference is a phenomenon which occurs when adjacent dots contact each other and combine together. Landing interference is a phenomenon which is closely linked to the depositing positions and the dot diameter. For example, even in a state where the depositing position error is the same, the presence or absence of landing interference varies depending on the size of the dot diameter. Furthermore, the presence and absence of landing interference also varies in a similar fashion in cases where the dot diameter is the same but there is change in the degree of the depositing position error.

Moreover, the presence or absence of landing interference also varies with the time difference of droplet ejection between the peripheral dots, in other words, the deposition sequence. FIGS. 17A and 17B are schematic drawings for describing the presence or absence of landing interference depending on the deposition sequence. FIGS. 17A and 17B assume an ideal state where the depositing position error and the dot diameter of the nozzles 320 in the head 300 described in relation to FIG. 13 are the same in all of the nozzles, and show a case where there is a nozzle of the nozzles in this head 300 which has suffered ejection failure.

FIG. 17A shows a case where one nozzle NB_k has suffered ejection failure, of the nozzle row situated to the upstream side of the paper conveyance direction in the head 300 (in FIG. 13, the lower-stage nozzle row; hereinafter "upstream nozzle row"). In the head 300 in FIG. 13, ejection is performed firstly from the upstream nozzle row which is situated on the upstream side in terms of the conveyance direction of the paper 340, whereupon ejection is performed from the nozzle row on the downstream side (the upper-stage nozzle row in FIG. 13).

In other words, there is a time difference between droplet ejection from the upstream nozzle row and the downstream nozzle row (in other words, a deposition time difference). The left-hand side diagram in FIG. 17A shows a state where a liquid droplet 350B ejected from a nozzle in the upstream nozzle row reaches the surface of the paper 340 before a liquid droplet 350A ejected from a nozzle in the downstream nozzle row. If the nozzle NB_k belonging to the upstream nozzle row is suffering an ejection failure, then no liquid droplet is present on the position on the surface of the paper corresponding to the ejection failure nozzle NB_k. In FIG. 17A, an ejection failure is indicated by a broken line.

In this case, the droplets 350A_k−1 and 350A_k+1 ejected from the nozzles adjacent to the ejection failure nozzle NB_k (hereinafter, a nozzle adjacent to an ejection failure nozzle is called an "adjacent to ejection failure nozzle") aggregate with the droplets 350B_k−2 and 350B_k+2 ejected previously by adjacent nozzles further to the outside. The depositing position error of an adjacent to ejection failure nozzle is increased by this aggregating action (landing interference), and the droplet ejection pitch (pitch between dots) before and after the ejection failure nozzle NB_k is increased. More specifically, the pitch ΔSA between dots formed by droplets ejected by a pair of adjacent to ejection failure nozzles becomes greater (see the right-hand figure in FIG. 17A).

On the other hand, FIG. 17B shows a case where one nozzle NA_j has suffered ejection failure, of the nozzle row situated to the downstream side in terms of the paper conveyance direction in the head 300 shown in FIG. 13 (in FIG. 13, the upper-stage nozzle row; hereinafter "downstream nozzle row").

In this case, the liquid droplets 350B_k−2 and 350B_k+2 which are ejected by the adjacent nozzles (adjacent to ejection failure nozzles) before and after the ejection failure nozzle NA_j are deposited first on the paper surface, and therefore an aggregating action (landing interference) as described above does not occur. Therefore, the droplet ejection pitch (pitch between dots) before and after the ejection failure nozzle NA_j is narrower than in the case of FIG. 17A. In other words, the pitch ΔSB between the dots formed by droplets ejected by the pair of adjacent to ejection failure nozzles becomes narrow as shown on the right-hand side in FIG. 17B (ΔSB<ΔSA).

In FIGS. 17A and 17B, the droplets (dots) deposited on the paper surface are depicted as having a spherical shape, but this is for the sake of simplicity in order to clarify the relationship between the ejected droplets 350A and 350B, and in actual practice the deposited droplets (dots) have a shape which spreads over the paper surface at an angle of contact that is defined by the properties of the liquid and the surface properties of the paper surface.

As described above, even in an ideal case where the depositing position error and the dot diameter of the nozzles 320 in the head 300 shown in FIG. 13 are the same in all of the nozzles, the positional error can increase depending on the deposition sequence, the droplet ejection pitch before and after the ejection failure nozzle can become larger or smaller, and the visibility of the stripes can vary greatly.

In this way, in image formation by an inkjet head, it is not possible to ignore the effects of landing interference. The ejection failure correction technology is also affected by these factors. In Japanese Patent Application Publication No. 2007-160748, the depositing position error of each nozzle is calculated in advance, but in this measurement, it is necessary to create conditions where no image formation is performed in the vicinity of the nozzle for which the position error is to be measured, and landing interference does not occur.

However, when actually performing image formation, as shown in FIGS. 17A and 17B, landing interference occurs and therefore the measurement value of the position error measured under conditions where landing interference does not occur diverges greatly from the actual value. Consequently, correction technology using a general technique which considers only depositing position error and ejected droplet volume error can produce results in which a combination of blank stripes and white stripes are visible on the surface of the paper ((d) of FIG. 16).

SUMMARY OF THE INVENTION

The present invention has been contrived in view of these circumstances, an object thereof being to provide an image processing method and an image processing apparatus capable of improving correction performance by resolving issues of a general correction technology described above, an inkjet image forming apparatus equipped with this correction function, and a method of generating correction coefficient data used in this correction processing.

In order to attain an object described above, one aspect of the present invention is directed to an image processing method of creating image data for forming an image on a recording medium by ejecting liquid droplets from a plurality of nozzles of a recording head onto the recording medium while causing relative movement of the recording medium and the recording head, the image processing method comprising: a correction coefficient storage step of determining correction coefficients for ejection failure correction based on difference of landing interference patterns of a plurality of types, according to correspondence information indicating correspondence relationship between the landing interference patterns and the respective nozzles, the landing interference patterns being based on a landing interference inducing factor including a deposition sequence of the liquid droplets on the recording medium that is defined by an arrangement configuration of the plurality of nozzles and a direction of the relative movement, and storing the correction coefficients for ejection failure correction according to the landing interference patterns, in a storage unit; an ejection failure nozzle position information acquisition step of acquiring ejection failure nozzle position information indicating a position of an ejection failure nozzle which cannot be used for forming the image, of the plurality of nozzles; and a correction processing step of performing a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle.

According to this aspect of the invention, correction performance is improved, because ejection failure correction is performed by using a correction coefficient which takes account of effects of landing interference on an ejection receiving medium of liquid droplets which are ejected by another nozzle peripheral to an ejection failure nozzle.

Desirably, the landing interference patterns are determined according to an amount of change in a droplet ejection pitch on the recording medium between liquid droplets ejected from two nozzles capable of forming dots at adjacent positions on either side of a position on the recording medium where droplet ejection by the ejection failure nozzle cannot be performed.

The depositing position pitch (droplet ejection pitch) on the ejection receiving medium between droplets ejected from a pair of adjacent nozzles which form dots that are adjacent to a position where droplet ejection is impossible due to an ejection failure nozzle changes due to effects of landing interference (aggregation) between droplets ejected from nozzles apart from the ejection failure nozzle. A desirable mode is one where a landing interference pattern is determined in view of the amount of change in the droplet ejection pitch as a result of landing interference.

Desirably, the amount of change varies depending on a droplet ejection sequence of nozzles other than the ejection failure nozzle.

The presence or absence of occurrence of landing interference and the circumstances of occurrence of the landing interference depend on the droplet ejection sequence of the other nozzles peripheral to the ejection failure nozzle.

Desirably, the landing interference patterns are determined further according to at least one information element of dot size formed by the liquid droplets and a depositing position error of the liquid droplets.

The landing interference inducting factor include, aside from the droplet ejection sequence, the dot diameter (a value which correlates to the volume of an ejection droplet) and the ejection position errors of the respective nozzles, and the like. A desirable mode is one where a correction coefficient is determined by also taking account of these factors.

Desirably, in the correction processing step, the correction calculation using the corresponding correction coefficient is performed on pixel information of an image prior to half-tone processing.

According to this aspect of the invention, ejection failure correction is applied to image data at the stage before half-tone processing (N-value conversion processing) for converting multiple-tone (M-value) image data into binary or multiple-value (N-value; N<M) dot data. By carrying out half-tone processing on the image data after ejection failure correction calculation, binary or multiple-value dot data (multiple values for different dot sizes) corresponding to the respective nozzles of the recording head are obtained. The dot data obtained in this way is data which enables favorable image output by the nozzles other than the ejection failure nozzle. Consequently, it is possible to form an image of high quality which resolves effects of ejection failure nozzles, by controlling droplet ejection from the respective nozzles on the basis of this dot data.

Desirably, in the correction processing step, the image data is corrected in such a manner that the output of the ejection failure nozzle is compensated by changing dot size formed by a liquid droplet ejected from a nozzle peripheral to the ejection failure nozzle according to the ejection failure nozzle position information.

By increasing size (diameter) of a dot formed at a position adjacent to a position where droplet ejection cannot be performed due to the ejection failure nozzle, it is possible to compensate for insufficient output density caused by a missing dot. According to this aspect of the invention, it is possible to apply correction to data after half-tone processing.

Desirably, the correspondence relationship between the landing interference patterns and the respective nozzles is classified into a plurality of groups, according to periodicity of nozzle arrangement in the arrangement configuration of the plurality of nozzles.

Since the periodicity of the nozzle arrangement is related to the deposition sequence (droplet ejection sequence) of droplets, then a desirable mode is one where the landing interference patterns are classified on the basis of this periodicity.

Desirably, the correspondence relationship between the landing interference patterns and the respective nozzles is classified into the plurality of groups, according to a symmetry property of the nozzle arrangement in the arrangement configuration of the plurality of nozzles, in addition to the periodicity.

If the nozzle arrangement pattern has symmetry, then a desirable mode is one where the landing interference patterns are classified by taking account of the symmetry in addition to the periodicity.

In order to attain an object described above, another aspect of the present invention is directed to an image processing apparatus for creating image data for forming an image on a recording medium by ejecting liquid droplets from a plurality of nozzles of a recording head onto the recording medium while causing relative movement of the recording medium and the recording head, the image processing apparatus comprising: a correction coefficient storage device which stores correction coefficients for ejection failure correction based on difference of landing interference patterns of a plurality of types, the correction coefficients being determined according to correspondence information indicating correspondence relationship between the respective nozzles and the landing interference patterns based on a landing interference inducing factor including a deposition sequence of the liquid droplets on the recording medium that is defined by an arrangement configuration of the plurality of nozzles and a direction of the relative movement, the correction coefficients for ejection failure correction being stored according to the landing interference patterns; an ejection failure nozzle position information acquisition device which acquires ejection failure nozzle position information indicating a position of an ejection failure nozzle which cannot be used for forming the image, of the plurality of nozzles; and a correction processing device which performs a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle.

According to this aspect of the invention, it is possible to provide an apparatus which realizes an image processing method as described above.

In order to attain an object described above, another aspect of the present invention is directed to an inkjet image forming apparatus comprising: a recording head having a plurality of nozzles for ejecting liquid droplets; a conveyance device which conveys at least one of the recording head and a recording medium so as to cause relative movement of the recording head and the recording medium; a correction coefficient storage device which stores correction coefficients for ejection failure correction based on difference of landing interference patterns of a plurality of types, the correction coefficients being determined according to correspondence information indicating correspondence relationship between the respective nozzles and the landing interference patterns based on a landing interference inducing factor including a deposition sequence of the liquid droplets on the recording medium that is defined by an arrangement configuration of the plurality of nozzles and a direction of the relative movement, the correction coefficients for ejection failure correction being stored according to the landing interference patterns; an ejection failure nozzle position information acquisition device which acquires ejection failure nozzle position information indicating a position of an ejection failure nozzle which cannot be used for forming the image, of the plurality of nozzles; a correction processing device which performs a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle; and a droplet ejection controller which controls droplet ejection of the recording head according to the image data generated by the correction processing device.

According to this aspect of the invention, it is possible to provide an inkjet image forming apparatus equipped with an ejection failure correction function of an image processing method as described above.

Desirably, the inkjet image forming apparatus further comprises a test chart creation device which creates test charts of a plurality of types corresponding to the respective landing interference patterns, according to the correspondence information, wherein the correction coefficients for ejection failure correction are determined respectively for the landing interference patterns, according to output results of the test charts of the plurality of types created respectively for the landing interference patterns.

According to this aspect of the invention, an inkjet image forming apparatus including a function for generating test charts for determining correction coefficients required for ejection failure correction processing is provided.

Desirably, the correction coefficient storage device stores a look-up table specifying relationship of the correction coefficients with respect to image setting values, according to the landing interference patterns.

In order to attain an object described above, another aspect of the present invention is directed to a correction coefficient data generating method of generating correction coefficient data for ejection failure correction to be used in correction processing for compensating for output of an ejection failure nozzle which cannot be used for image formation, by a nozzle other than the ejection failure nozzle, when the ejection failure nozzle is present in an inkjet image forming apparatus which includes a recording head having a plurality of nozzles for ejecting liquid droplets and deposits the liquid droplets ejected from the plurality of nozzles onto a recording medium while causing relative movement of the recording medium and the recording head so as to form an image on the recording medium, the correction coefficient data generating method comprising: a test chart forming step of forming test charts of a plurality of types corresponding to landing interference patterns of a plurality of types, by performing an ejection disabling process of artificially disabling liquid ejection in different nozzles corresponding to difference of the landing interference patterns, according to correspondence information indicating correspondence relationship between the respective nozzles and the landing interference patterns based on a landing interference inducing factor which includes a deposition sequence of the liquid droplets on the recording medium that is defined by an arrangement configuration of the plurality of nozzles and a direction of the relative movement; a correction coefficient determination step of determining correction coefficients for ejection failure correction respectively for the landing interference patterns, from output results of the test charts of the plurality of types created respectively for the landing interference patterns; and a storage step of storing the landing interference patterns and the correction coefficients determined respectively for the landing interference patterns in association with each other in a storage device.

Desirably, the test charts include a plurality of patches formed by altering the correction coefficient, and a patch that has yielded a best image quality is selected from among the plurality of patches and a correction coefficient used in the formation of that patch is determined as the correction coefficient for ejection failure correction.

According to the present invention, the correction coefficients for the respective nozzles are determined in accordance with landing interference patterns which take account of effects of landing interference between droplets ejected by other nozzles peripheral to an ejection failure nozzle, and therefore correction performance is improved in comparison with conventional correction methods. According to the present invention, therefore, it is possible to achieve improvement in output image quality.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

First Embodiment

Figure 1:
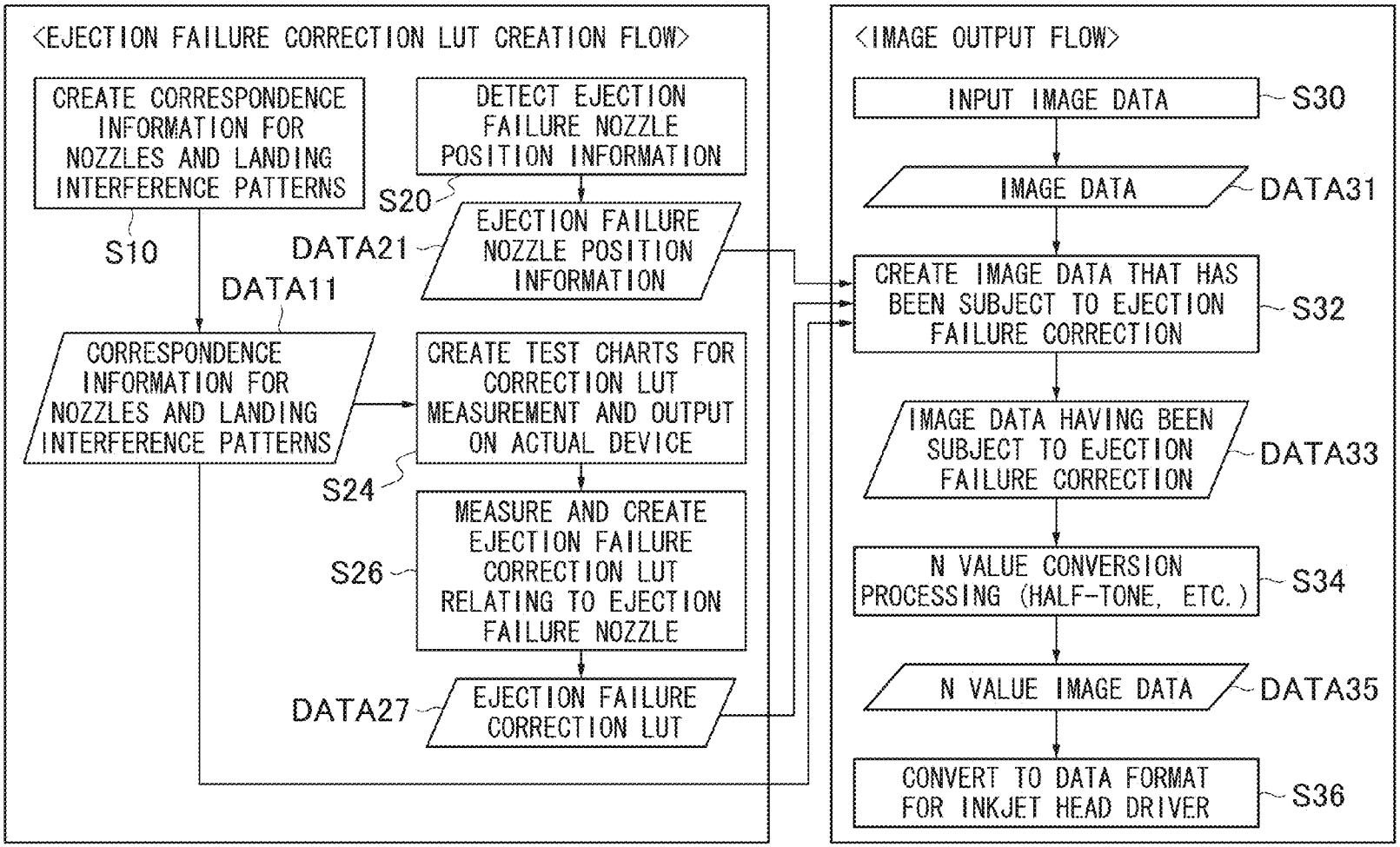
FIG. 1 is a flowchart of an image processing method relating to one embodiment of the present invention.

FIG. 1 is a flowchart of an image processing method relating to one embodiment of the present invention. To give a general description of the overall flow of image correction processing according to the present embodiment, firstly, [1] a test chart for ejection failure correction LUT measurement is output, [2] an ejection failure correction LUT is created by analyzing this test chart, and [3] correction of the image data is carried out using the ejection failure correction LUT thus created. In FIG. 1, steps until obtaining the ejection failure correction LUT (DATA 27 in FIG. 1) are called the "ejection failure correction LUT creation flow", and steps of actually performing a correction process of the input image data by using this ejection failure correction LUT (S30 to S36 in FIG. 1) are called the "image output flow".

Description of Ejection Failure Correction LUT Creation Flow

Firstly, the ejection failure correction LUT creation flow will be described. In the present embodiment, correspondence information for the nozzle positions in the head and the landing interference patterns is required. It is necessary to create correspondence information of this kind by the judgment of the manufacturer (a person who designs and manufactures the apparatus), on the basis of the head design information and head installation status, and the like (step S10).

Here, in order to simplify the description, the inkjet head 10 shown in FIG. 2 (which corresponds to a "recording head"; hereinafter, referred to simply as "head") is envisaged. This head 10 has a similar composition to the head 300 described in FIG. 13, and is composed by arranging a plurality of head modules 12 in a staggered configuration. Each of these head modules 12 has a nozzle row in which a plurality of nozzles 20 are arranged at uniform pitch Pm. For the sake of this description, the number of nozzles shown is reduced and nozzle rows are depicted in which five nozzles 20 are arranged in one row in each head module 12, but in an actual head, several tens to several hundreds of nozzles may be provided in each head module, and furthermore, a mode may be adopted in which several hundred to several thousand of nozzles are arranged two-dimensionally.

A group of nozzles in a nozzle row 22A constituted by a head module arranged in the upper level in FIG. 2 (the head module labeled with reference numeral "12_A" below) is called "nozzle group A" and a group of nozzles in a nozzle row 22B constituted by a head module arranged in the lower level in FIG. 2 (the head module labeled with reference numeral "12_B" below) is called "nozzle group B".

Figure 2:
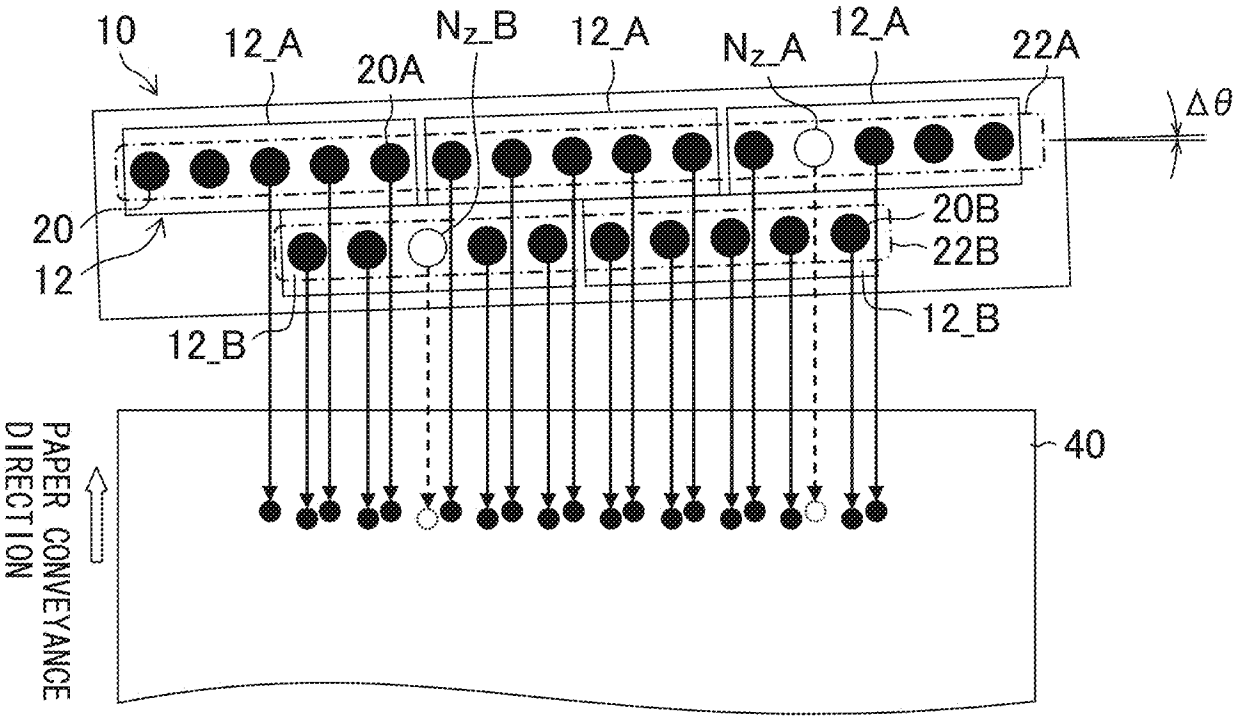
FIG. 2 is a plan diagram showing one example of a nozzle arrangement in a head.

Paper 40 which forms an image receiving medium is conveyed from the lower side to the upper side in FIG. 2, with respect to the head 10 having a nozzle arrangement of this kind. The paper conveyance direction is taken as the y direction and the width direction of the paper perpendicular to same is taken as the x direction. The head 10 and the paper 40 should be movable relative to each other, and for example, the paper 40 may be stationary and the head 10 may be moved from the upper side toward the lower side in FIG. 2, or both the head 10 and the paper 40 may be movable.

Figure 13:
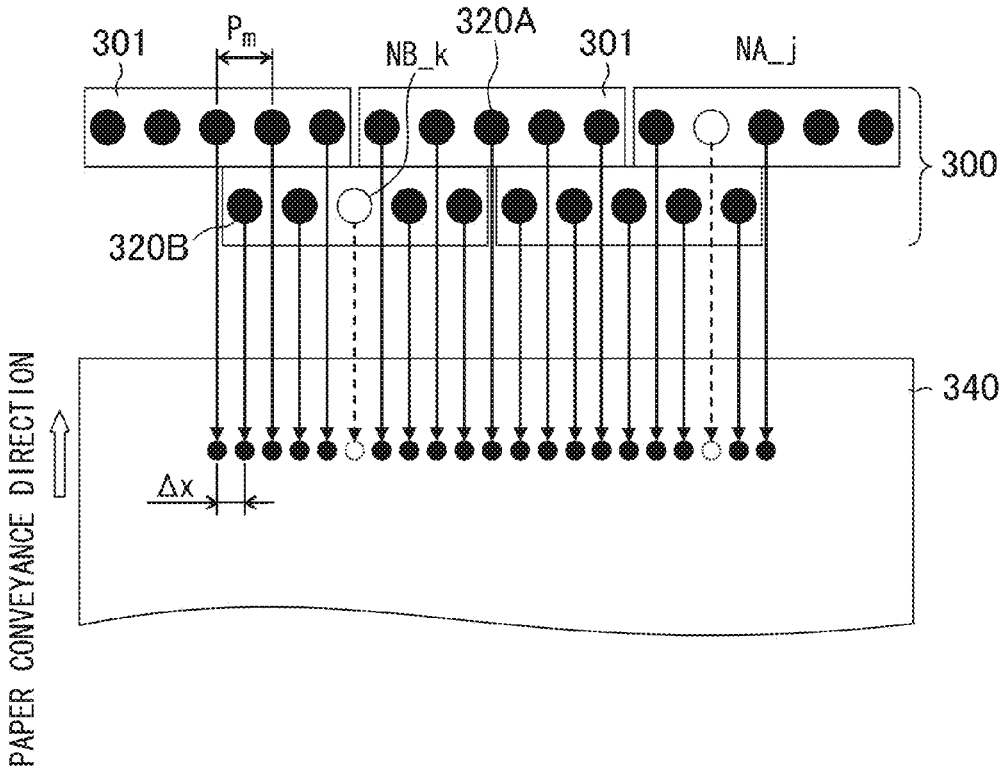
FIG.13 RELATED ART
FIG. 13 is a plan diagram showing an example of a nozzle arrangement in an inkjet head.
Figure 14:
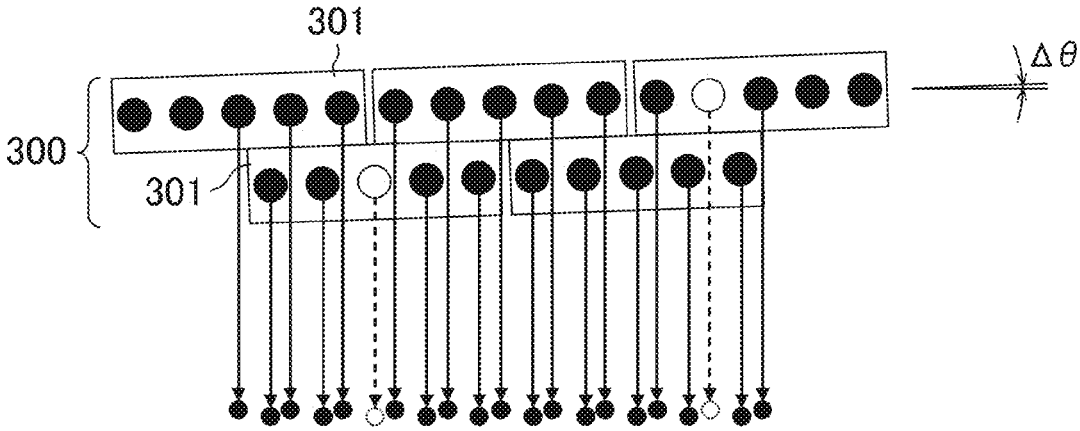
FIG.14 RELATED ART
FIG. 14 is a diagram showing a state where the head in FIG. 13 has been installed with a residual amount of rotation ($\Delta\theta$)
Figure 15:
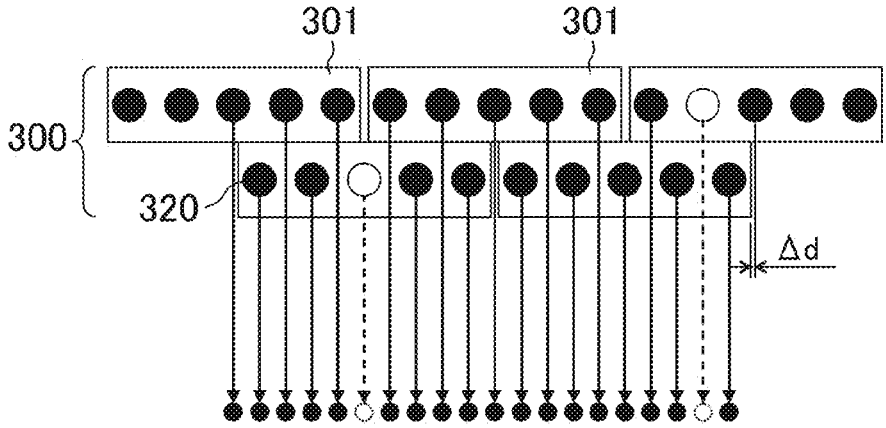
FIG.15 RELATED ART
FIG. 15 is a diagram showing a state where the head in FIG. 13 is installed with residual arrangement divergence ($\Delta d$) in one of the head modules constituting the head.

FIG. 2 shows a state where the head 10 is installed in a printing apparatus in a state having a residual amount of rotation ($\Delta\theta$). If the head 10 is installed in a regulation position without any rotation ($\Delta\theta=0$), then as shown in FIG. 13, an ideal composition is achieved in which the nozzles 20 are arranged at uniform pitch (Pm/2) in the x direction.

Depending on the direction of conveyance of the head 10 and the paper 40 shown in FIG. 2, when forming an image on the paper 40 (for example, when forming a line in the x direction), the droplets ejected from the nozzles belonging to the nozzle group B (hereinafter, labeled as nozzles "20B") situated on the upstream side in terms of the paper conveyance direction land first on the paper 40, and droplets ejected from the nozzles belonging the nozzle group A on the downstream side (hereinafter, labeled as nozzles "20A") land on the paper 40 subsequently.

In other words, there is a time difference between the droplet ejection timings of the nozzle group B and the nozzle group A, the droplets ejected from the nozzles 20B of the nozzle group B land first on the paper 40, and the droplets ejected from the nozzles 20A of the nozzle group A land subsequently between the dots formed by the previously deposited droplets (the dots formed by droplets ejected from the nozzles 20B of the nozzle group B) so as to cover between the previously deposited droplets. In this way, a continuous dot row is formed in which the deposited droplets ejected by the nozzles 20B (previously deposited droplets) and the deposited droplets ejected by the nozzles 20A (subsequently deposited droplets) are arranged alternately in the x direction on the paper 40, and a line is recorded by this dot row.

In the example in FIG. 2, one nozzle $N_z$_A (indicated by a white circle in FIG. 2) belonging to the upper-level nozzle group A is suffering an ejection failure, and one nozzle $N_z$_B (indicated by a white circle in FIG. 2) belonging to the lower-level nozzle group B is suffering an ejection failure. As described in relation to FIGS. 17A and 17B, the effects of landing interference in the periphery of each ejection failure nozzle differ between a case where a nozzle $N_z$_B belonging to the nozzle group B in the upstream nozzle row is suffering an ejection failure and a case where a nozzle $N_z$_A belonging to the nozzle group A in the downstream nozzle row is suffering an ejection failure.

Figure 17A:
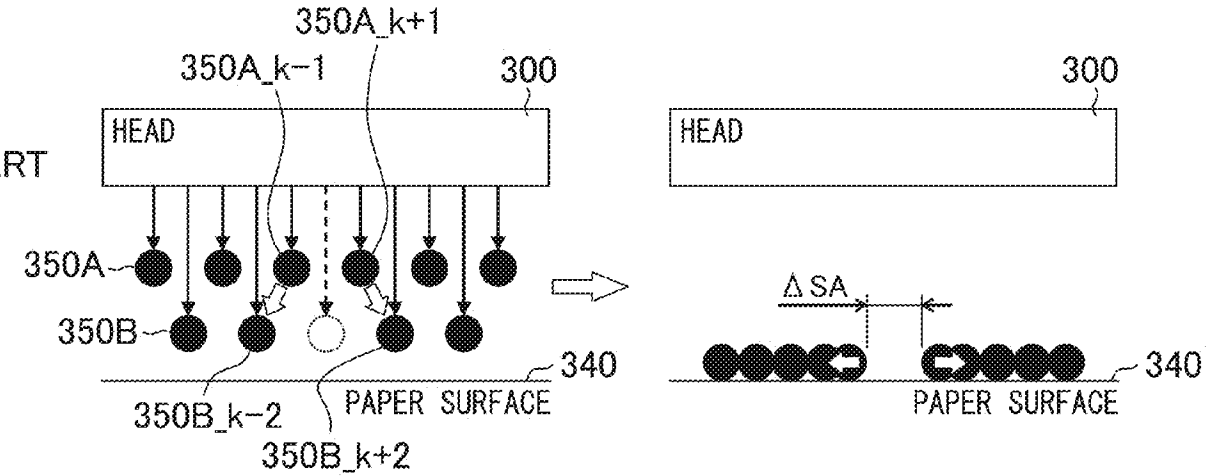
FIG.17A RELATED ART
FIGS. 17A and 17B are illustrative diagrams used to explain the effects of landing interference caused by droplet ejection from a nozzle peripheral to an ejection failure nozzle.

In other words, if the nozzle $N_z$_B belonging to the nozzle group B has suffered an ejection failure, then as shown in FIG. 17A, the dots which are mutually adjacent on the left and right-hand sides of the ejection failure position (unrecordable dot position) corresponding to this ejection failure nozzle $N_z$_B (namely, the dots formed by droplets ejected by nozzles 20A of the nozzle group A) are respectively drawn toward the previously deposited droplets which have been deposited previously on the paper 40 (see FIG. 17A). Due to this aggregating effect (landing interference), the depositing position error of the nozzles adjacent to the ejection failure nozzle $N_z$_B (the adjacent to ejection failure nozzles) increases, the pitch between the dots of this pair of adjacent to ejection failure nozzles increases, and hence the gap between the dots which are adjacent on either side of the missing dot position corresponding to the ejection failure nozzle $N_z$_B becomes larger.

Figure 17B:
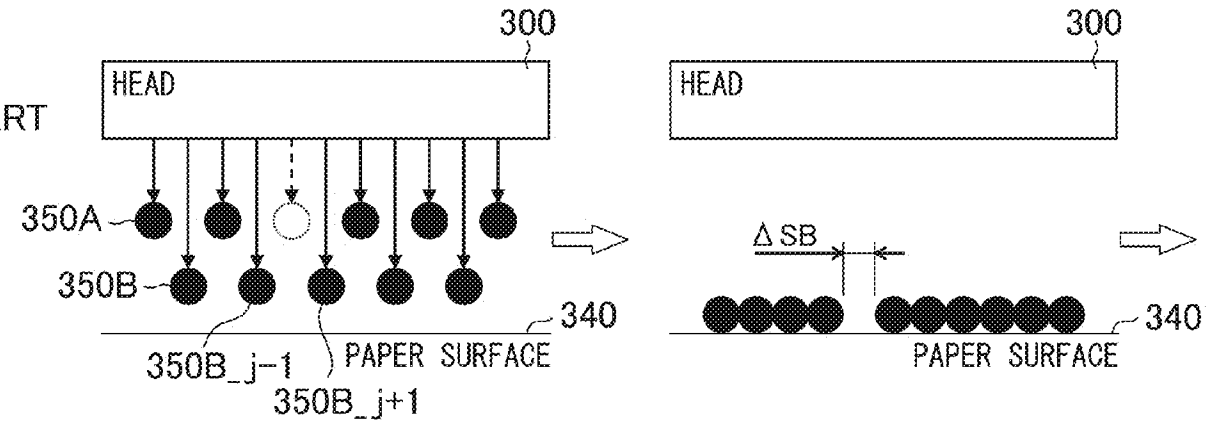
FIG.17B RELATED ART

On the other hand, if a nozzle $N_z$_A belonging to the nozzle group A has suffered an ejection failure, then as shown in FIG. 17B, the dots which are mutually adjacent on the left and right-hand sides of the missing dot position corresponding to this ejection failure nozzle $N_z$_A (namely, dots formed by droplets ejected by nozzles 20B of the nozzle group B) land previously on the paper 40, and therefore aggregation (landing interference) such as that described above does not occur. Therefore, the gap between the dots which are adjacent on either side of the missing dot position corresponding to the ejection failure nozzle $N_z$_A becomes narrower than a case where a nozzle $N_z$_B of the nozzle group B is suffering an ejection failure.

In this way, the effects of landing interference vary depending on the position of the ejection failure nozzle (depending on the group the ejection failure nozzle belongs to), and the appearance of the image defect caused by the ejection failure (white stripe or density non-uniformity) varies. If another nozzle 20A belonging to the same nozzle group A suffers an ejection failure, then this produces a similar effect to that when the nozzle $N_z$_A suffers an ejection failure. Furthermore, if another nozzle 20B belonging to the same nozzle group B suffers an ejection failure, then this produces a similar effect to that when the nozzle $N_z$_B suffers an ejection failure.

The pattern of occurrence of landing interference (attribute) arising when the nozzle 20A belonging to the nozzle group A has suffered an ejection failure is called "landing interference pattern A" and the pattern of occurrence of landing interference arising when the nozzle 20B belonging to the nozzle group B has suffered an ejection failure is called "landing interference pattern B". In other words, in the present embodiment, it is considered that all of the nozzles 20A belonging to the same nozzle group A have the same factor inducing the landing interference pattern A as the nozzle $N_z$_A belonging to the same group A and all of the nozzles 20B belonging to the nozzle group B have the same factor inducing the landing interference pattern B as the nozzle $N_z$_B belonging to the same group B. The landing interference patterns A and B show differences due to the landing interference induction factor (here, the deposition sequence) of the nozzle groups A and B.

As stated previously, the nozzles 20A belonging to the nozzle group A correspond to the "landing interference pattern A" and the nozzles 20B belonging to the nozzle group B correspond to the "landing interference pattern B". In step S10 in FIG. 1, information (correspondence information) specifying this correspondence relationship is created.

In the head structure of the present embodiment which is shown in FIG. 2, landing interference patterns A and B of two types corresponding to nozzle groups A and B are described, but depending on the design of the head, the landing interference patterns may be classified into more than two types. Furthermore, the occurrence or non-occurrence of landing interference depending on the nozzle group A or B in the head structure in FIG. 2 has been discussed here, but it is also possible to take account of other factors, such as the ejected droplet volume (dot diameter) and the depositing position, and to handle the extent of the effect of landing interference (change in the amount of variation of the position error due to landing interference), as an attribute (pattern) of the landing interference.

A test chart for correction LUT measurement is created on the basis of the correspondence information (DATA 11) created in this way (step S24).

Figure 3:
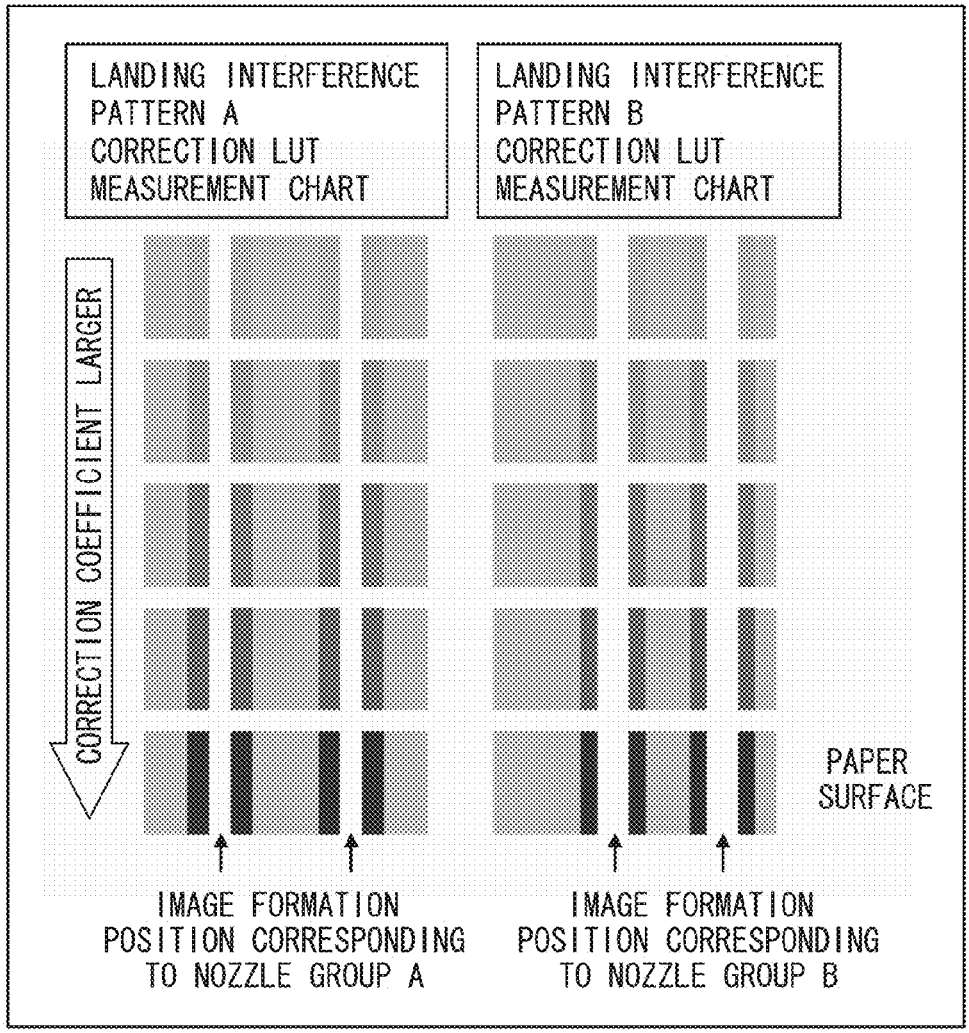
FIG. 3 is an illustrative diagram showing an example of test charts for correction LUT measurement.

FIG. 3 shows an example of a test chart for correction LUT measurement. The chart shown on the left-hand side of FIG. 3 is a chart for correction LUT measurement corresponding to the landing interference pattern A, and the chart shown on the right-hand side of FIG. 3 is a chart for correction LUT measurement corresponding to the landing interference pattern B.

In this way, a test chart for correction LUT measurement is created, separately for each landing interference pattern. When creating a chart for correction LUT measurement for the landing interference pattern A, a particular nozzle belonging to the nozzle group A corresponding to the landing interference pattern A (for at least one nozzle and desirably for a plurality of nozzles spaced at suitable intervals apart) is placed in an ejection failure status by taking the image setting value at the image formation positions of the nozzle group A corresponding to the landing interference pattern A to be 0 for such a particular nozzle belonging to the nozzle group A corresponding to the landing interference pattern A, or by issuing an ejection disabling command to the head driver (drive circuit) so as not to eject ink (so as not to perform image formation from particular nozzles). A nozzle set artificially to an ejection failure status in this way is called an "artificial ejection failure nozzle". At the same time as an ejection disabling process of this kind, the image setting values of the image formation positions of the adjacent nozzles before and after the artificial ejection failure nozzle are set to values obtained by multiplying a correction coefficient by the basic image setting value corresponding to a solid image of a prescribed density (tone value). A plurality of patches are formed while varying, in stepwise fashion, the correction coefficient applied to the basic image setting value corresponding to a particular density.

In FIG. 3, in order to simplify the drawings, the correction coefficient is changed in five steps, and five patches corresponding to five different correction coefficients are formed, but there are no particular restrictions on the number of steps in which the correction coefficient is changed. Furthermore, here, only a chart (group of patches) relating to one basic image setting value corresponding to a particular density is depicted, but similar groups of patches are formed for a plurality of basic image setting values of different densities (tone values).

For example, the range of tones from 0 to 255 is divided equally into 32 steps, and 20 patch groups are formed by changing the correction coefficient in 20 steps, for the basic image setting value of each tone (density). In other words, 32×20 patches are created in respect of one artificial ejection failure nozzle. From the viewpoint of raising measurement accuracy (improving measurement reliability), it is desirable to have a plurality of artificial ejection failure nozzles, and similar patch groups are formed in respect of the plurality of artificial ejection failure nozzles.

If a chart for correction LUT measurement is created for the landing interference pattern B as shown on the right-hand side in FIG. 3, an ejection disabling process similar to that described above is carried out in respect of a particular nozzle belonging to the nozzle group B corresponding to the landing interference pattern B (at least one nozzle and desirably a plurality of nozzles spaced at suitable intervals apart), the image setting values for the image formation positions of the adjacent nozzles before and after the artificial ejection failure nozzle are set to a value obtained by multiplying the basic image setting value by a correction coefficient, similarly to the foregoing description, and a plurality of patches are formed by varying the correction coefficient in a stepwise fashion.

Furthermore, if a plurality of heads are provided according to ink colors corresponding to inks of a plurality of colors (for example, four colors of C, M, Y and K), then charts according to the colors (charts according to the heads) are also created.

Although it is desirable to form all of the correction LUT charts for the landing interference pattern A and the correction LUT charts for the landing interference pattern B on one sheet of paper 40, it is also possible to output the charts on separate sheets of paper 40 for each of the landing interference patterns A and B, or to output the charts on separate sheets of paper for each ink color (head).

The charts for correction LUT measurement relating to the landing interference patterns A and B are formed and output in this way by an actual device (inkjet recording apparatus) (step S24 in FIG. 1), and an ejection failure correction LUT is created by measuring the output results (charts) (step S26).

Figure 4A:
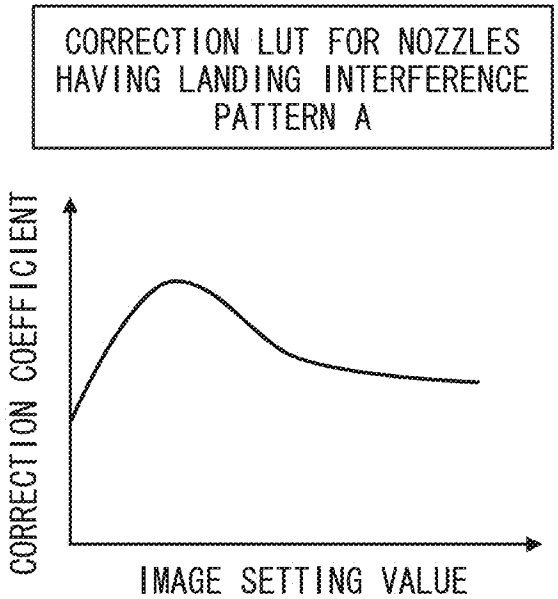
FIGS. 4A and 4B are diagrams showing an example of a raster obtained by applying an embodiment of the present invention to a head having a two-dimensional nozzle arrangement in 2 rows and N columns.

More specifically, in the measurement in step S26, the patch using the correction coefficient which produces the best visual impression (the best output image quality without conspicuous stripes) is selected from the plurality of patches which have been formed using different correction coefficients in the correction LUT charts. In this way, the best correction coefficient is determined for each basic image setting value and for each of the landing interference patterns A and B, and an ejection failure correction LUT (DATA 27) for each landing interference pattern is obtained (see FIGS. 4A and 4B). FIG. 4A shows one example of a correction LUT for nozzles having the landing interference pattern A and FIG. 4B shows one example of a correction LUT for nozzles having the landing interference pattern B.

Figure 4B:
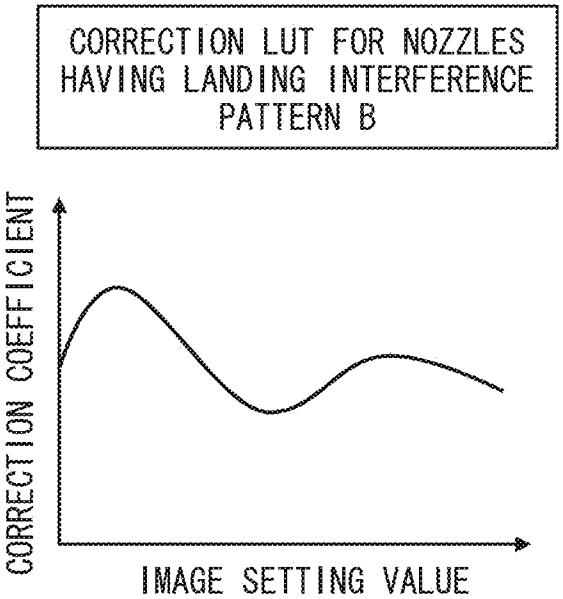

The horizontal axis in FIG. 4A and FIG. 4B shows an image setting value indicating the instructed solid density (base tone value) when forming the test chart, and the vertical axis indicates the value determined as the correction coefficient producing the best correction effect. FIGS. 4A and 4B show a smooth continuous graph, but if test charts are created for base tone values in 32 steps in the range from a value of 0 to 255, then discrete data corresponding to these respective values is obtained. Intermediate data is estimated from these discrete data by means of a common interpolation method.

Furthermore, separately from the step for obtaining the ejection failure correction LUT for each landing interference pattern as described above (FIGS. 4A and 4B) (S24 to S26), before these steps (S24 to S26) or after these steps (S24 to S26), ejection failure nozzle position information which is required for correcting ejection failure is determined (step S20).

The ejection failure nozzle position information contains, for example, [1] information measured from the output results of a prescribed test pattern for ejection failure nozzle position detection (for instance, a test pattern including line patterns of all of the nozzles based on so-called 1-on N-off method), and [2] the positions of nozzles which have been judged to be defective nozzles (known ejection failure nozzles, ejection deviations, droplet volume abnormalities, permanently open state, etc.) and which have been received a disabling processing which disables them from ejection so that they cannot be used, and the like.

The ejection failure nozzle position information is stored in a non-volatile memory, or on the hard disk or another storage device in the apparatus, and this information is updated appropriately as and when required.

Description of Image Output Flow

There follows a description of the image output flow which includes ejection failure correction processing using the ejection failure nozzle position information and the ejection failure correction LUT described above.

Firstly, image data which is the object of image formation is input (step S30 in FIG. 1). The device for inputting the image data (input interface) may employ a media interface for acquiring information from an external storage medium (removable media), such as a memory card, optical disk, or the like, or a communications interface (either wired or wireless). Furthermore, it is also possible to interpret a signal input line on which input image data is transmitted, as an "image data input device".

Here, it is supposed that multiple-value tone image data is supplied for each of the ink colors in an inkjet image forming apparatus (for example, 256-tone image data for each of the colors corresponding to the four colors of CMYK).

If 24-bit RGB full-color image data (8 bits per color) is input, or if there is a difference between the resolution of the input image and the output resolution of the inkjet image forming apparatus, then commonly known color conversion processing and resolution conversion processing are carried out.

Next, ejection failure correction processing is carried out on the input image data (DATA 31) (step S32). In performing this ejection failure correction, a correction LUT to be used for the ejection failure correction of each ejection failure nozzle is selected by referring to the ejection failure correction LUT (DATA 27) on the basis of the correspondence information (DATA 11) between the nozzle positions and landing interference patterns, and the ejection failure nozzle position information (DATA 21). The correction coefficient obtained from the selected correction LUT is multiplied by the image setting values before and after the ejection failure nozzle to create ejection failure corrected image data.

Following the examples in FIG. 2 to FIGS. 4A and 4B, if an ejection failure nozzle indicated in the ejection failure nozzle position information is a nozzle belonging to the nozzle group A, then the correction LUT for nozzles having landing interference pattern A (FIG. 4A) is referenced, and the value of the correction coefficient associated with the image value (image setting value) of the corresponding pixel position is acquired. The image data peripheral to the ejection failure nozzle is corrected by using the correction coefficient thus obtained.

Furthermore, if an ejection failure nozzle indicated in the ejection failure nozzle position information is a nozzle belonging to the nozzle group B, then the correction LUT for nozzles having landing interference pattern B (FIG. 4B) is referenced, and the value of the correction coefficient associated with the image value (image setting value) of the corresponding pixel position is acquired. The image data peripheral to the ejection failure nozzle is corrected by using the correction coefficient thus obtained.

The ejection failure corrected image data (DATA 33) obtained in this way is received the N value conversion processing for conversion to data based on N values (step S34) to obtain N value image data (DATA 35). The device which performs the N value conversion processing in step S34 may employ a commonly known half-toning device using error diffusion, dithering, a threshold value matrix, a density pattern, or the like. The half-toning process generally converts a tonal image data having M values ($M \geqq 3$) into tonal image data having N values ($N<M$). In the simplest example, the image data is converted into dot image data having 2 values (dot on/dot off), but in such a half-toning process, it is also possible to perform quantization based on multiple values which correspond to different types of dot size (for example, three types of dot: a large dot, a medium dot and a small dot).

The N-value image data (DATA 35) obtained by the N value conversion in step S34 is sent to the format conversion processing unit for the inkjet head driver, and is converted to a data format for the inkjet head driver (step S36). In this way, the data is converted into image data of a printable data format, and image data for output is obtained.

The ejection failure corrected image is formed by controlling droplet ejection from each nozzle of the inkjet head on the basis of this image data for output and outputting an image (performing image formation onto the paper 40).

Figure 5:
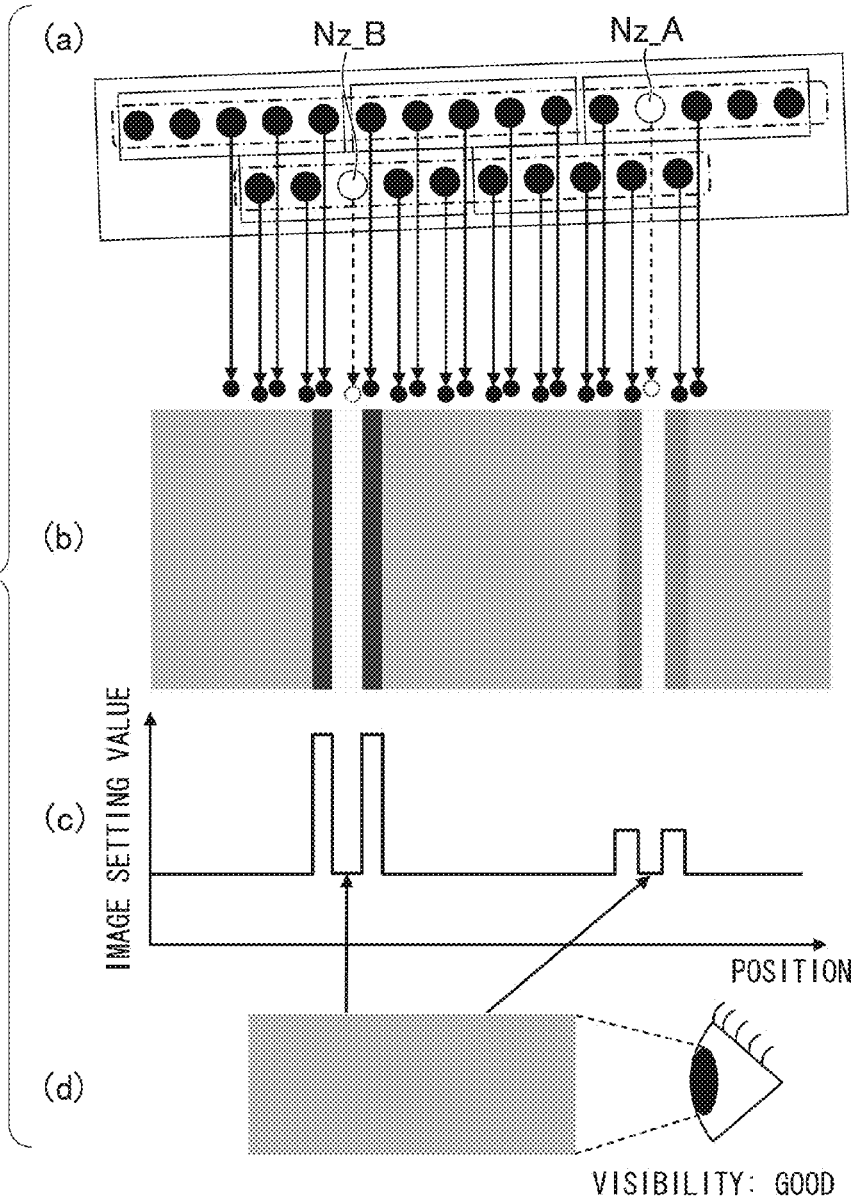
FIG. 5 illustrates a conceptual diagram in (a) to (d) showing a state where the image output flow in FIG. 1 has been implemented.

FIG. 5 illustrates schematic views of the results of image correction according to the present embodiment. As a comparison with the method described in relation to (a) to (d) of FIG. 16 reveals, in the present embodiment which is shown in (a) to (d) of FIG. 5, the correction coefficient peripheral to the ejection failure nozzle $N_z$_A belonging to the nozzle group A and the correction coefficient peripheral to the ejection failure nozzle $N_z$_B belonging to the nozzle group B are correct values corresponding to the respective landing interference patterns A and B, and the image setting value peripheral to the ejection failure nozzle $N_z$_A and the image setting value peripheral to the ejection failure nozzle $N_z$_B are both corrected to optimal values (see FIG. 5C).

Figure 16:
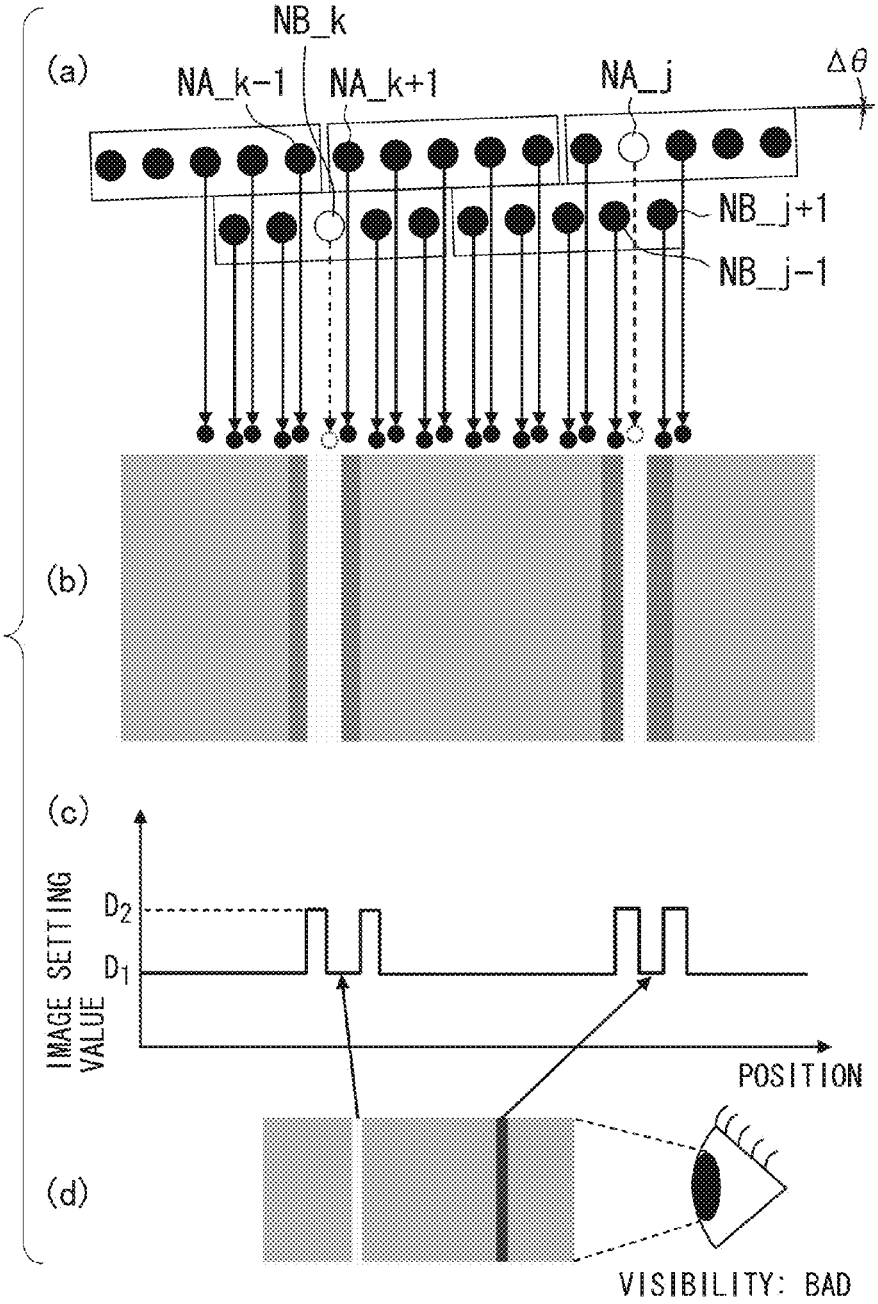
RELATED ART FIG.16
FIG. 16 illustrates a conceptual diagram in (a) to (d) explaining problems associated with the ejection failure correction technology.

Consequently, it is possible to resolve over-correction or under-correction of the causes of landing interference, which are problems in the related-art methods ((a) to (d) of FIG. 16) (see FIG. 5D), and a good image in which stripes caused by ejection failure nozzles are not conspicuous can be formed.

Further Action and Beneficial Effects

Moreover, according to the present embodiment, a beneficial effect is obtained in that the measurement and data volume can be made more efficient than in other methods. In other words, a large number of methods assume that a correction LUT (look-up table) is prepared for each nozzle. Optimizing the correction LUT for each nozzle by measuring all of the test charts one by one, or the like, requires an enormous amount of time and the data volume also becomes huge. On the other hand, in the present embodiment, particular attention is paid to the effects of landing interference, and the correction LUTs to be measured are effectively limited. Consequently, it is possible make measurement efficient and to reduce the volume of data.

Second Embodiment

Figure 6:
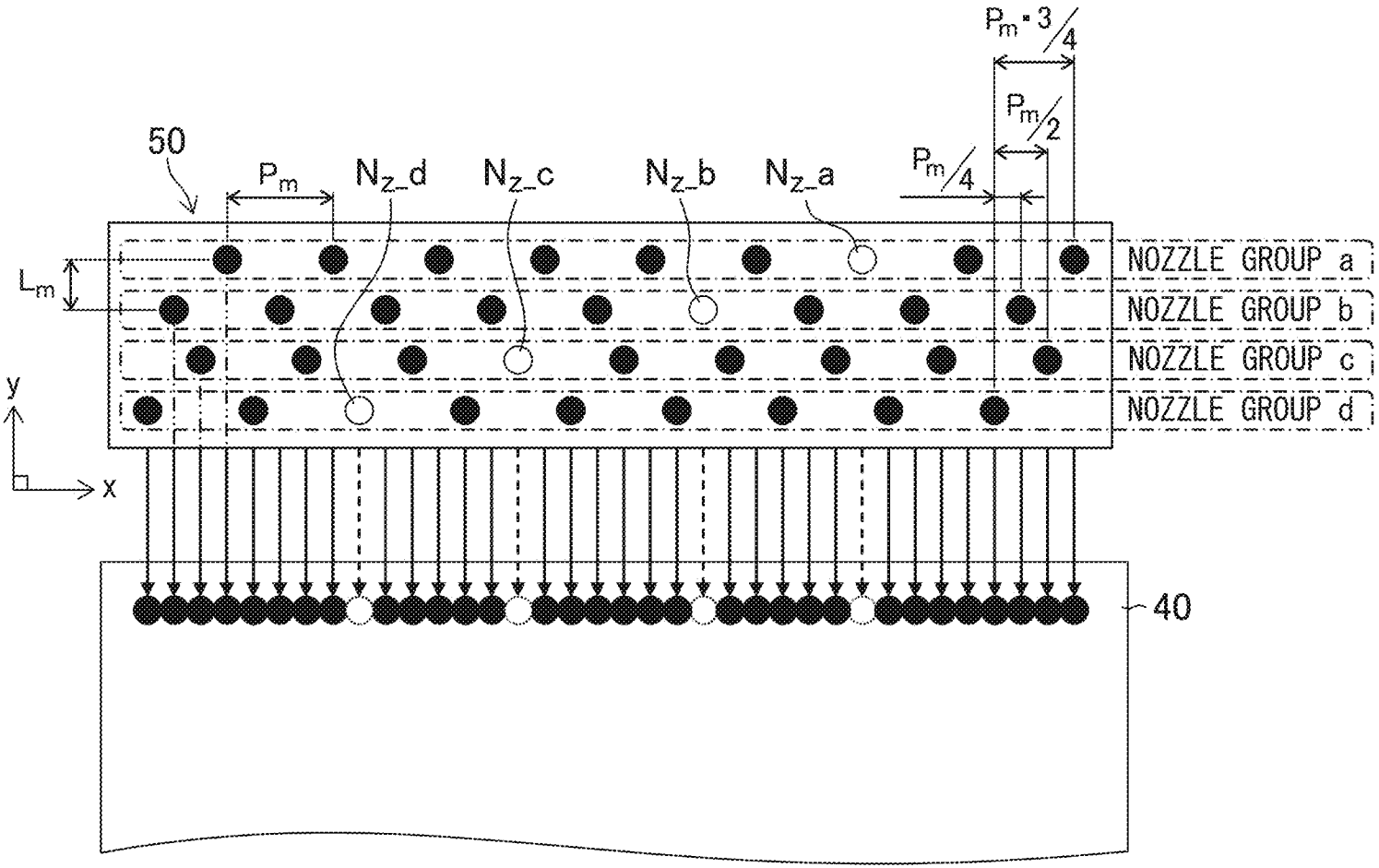
FIG. 6 is a plan diagrams showing an example of a head module according to a second embodiment of the present invention.

In the first embodiment, an example is given in which the nozzles in a head module 12 are arranged in a line shape. In implementing the present invention, the mode of arrangement of the nozzles is not limited to this. The second embodiment describes an example where nozzles are arranged in a matrix fashion. FIG. 6 shows an example of a nozzle arrangement of a head module 50 relating to the second embodiment. If the conveyance direction of the paper 40 is taken to be the y direction and the paper width direction perpendicular to this is taken to be the x direction, the nozzle arrangement of the head module 50 has four nozzle rows which have different positions in the y direction. The lowest level in FIG. 6 is called a first nozzle row, the level above this is called the second nozzle row, the level above this is called the third nozzle row, and the uppermost level is called a fourth nozzle row.

Looking in particular at each of the nozzle rows, the nozzle pitch Pm in the x direction within each row is uniform. Taking the nozzle positions of the first nozzle row as a reference, the nozzle positions of the second nozzle row are shifted by Pm/2 in the x direction. The nozzle positions of the third nozzle row are shifted by Pm/4 in the x direction with respect to the nozzle positions of the first nozzle row, and the nozzle positions of the fourth nozzle row are shifted by Pm×3/4 in the x direction with respect to the nozzle positions of the first nozzle row. If the group of nozzles arranged in a staggered configuration including the four rows in this way are projected onto the x axis, then the nozzles 20 are aligned at a uniform pitch (Pm/4) in the x direction. In other words, this head module 50 has a minimum recording pitch (dot pitch) of Pm/4 in the x direction on the paper 40.

As the paper 40 is conveyed, the first nozzle row which is situated on the furthest upstream side in terms of the paper conveyance direction (y direction) performs ejection first, and then droplet ejection is performed from the respective nozzle rows in the sequence, the second row, the third row and the fourth row, at droplet ejection timings having a time difference (Lm/v) specified by the paper conveyance speed v and the nozzle row pitch (distance between nozzle rows in the y direction) Lm; by this means it is possible to form a line of dots aligned in the x direction. In FIG. 6, the pitch between the nozzle rows (distance in the y direction) Lm is uniform, but it is also possible to adopt a mode in which the row pitch varies.

Looking at the correspondence between the alignment sequence of the dots aligned in mutually adjacent positions in the x direction on the paper 40, and the nozzles which record respective dots, in respect of a line (dot row) in the x direction recorded by the head module 50 in FIG. 6, there are dots formed by droplets ejected by nozzles of the third row in the right-hand adjacent positions to dots formed by nozzles of the first row, dots formed by droplets ejected by nozzles of the second row are formed adjacently to the right of these, and dots formed by droplets ejected by nozzles of the fourth row are formed further adjacently to the right of these. Dots formed by droplets ejected by nozzles of the first row are situated adjacently to the right of the dots formed by droplets ejected by nozzles of the fourth row, whereupon a similar sequence is repeated successively. In other words, if the nozzle row numbers which form the dot rows aligned in the x direction are expressed in the dot alignment sequence, then there is a periodicity based on a repeated unit of four nozzles: "1→3→2→4→1→3→2→4→ . . . (i.e. repetition of the first row—third row—second row—fourth row)".

In this way, when the matrix-shaped nozzle arrangement shown in FIG. 6 is replaced by a nozzle row aligned effectively in one row at different nozzle positions in the x direction (a nozzle row projected onto the x axis) and the resulting nozzle alignment sequence is observed, a periodic arrangement based on a sequence "1→3→2→4" of the nozzle row numbers is obtained.

Here, the repetition unit is "1→3→2→4", but the repetition unit can be represented as "3→2→4→1", "2→4→1→3" or "4→1→3→2".

In the case of an inkjet image forming apparatus which is equipped with a head module 50 having this nozzle arrangement, firstly, the nozzles are each classified depending on which landing interference pattern they belong to. As stated previously, the nozzle arrangement of the head module 50 in FIG. 6 has a periodicity based on a repetition unit of four nozzles. Therefore, firstly, the nozzle groups are classified into nozzle groups "a" to "d" on the basis of the periodicity.

Figure 7A:
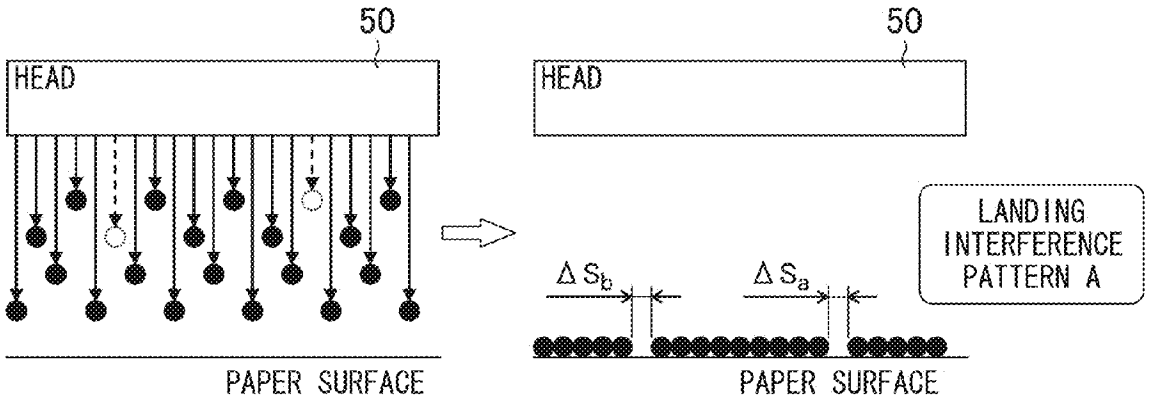
FIGS. 7A and 7B are illustrative diagrams of a landing interference pattern produced by the head module in FIG. 6.
Figure 7B:
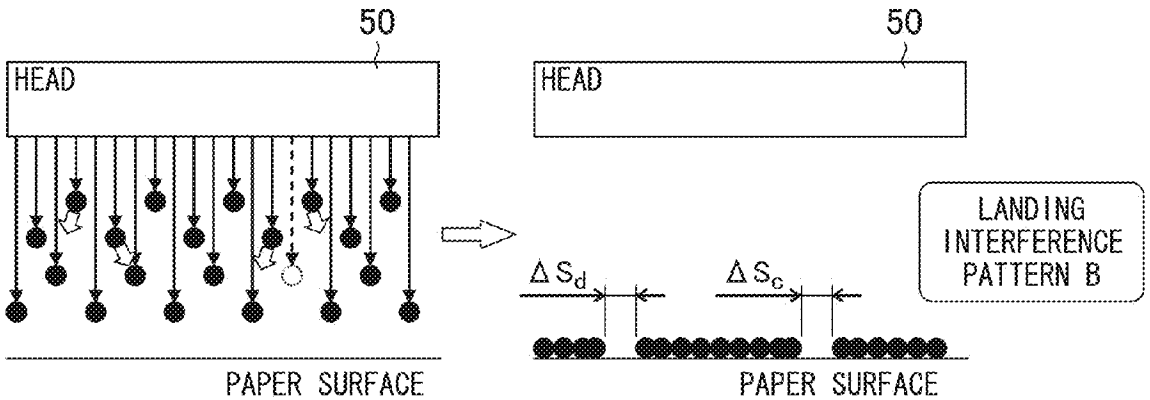

Thereupon, the type of landing interference that actually occurs when the nozzles belonging to the respective groups (in FIG. 6, the nozzles NZ_a, NZ_b, NZ_c, NZ_d) suffer ejection failure is investigated. FIG. 7A shows a state where a nozzle NZ_a and a nozzle NZ_b have suffered ejection failure, and FIG. 7B shows a state where a nozzle NZ_c and a nozzle NZ_d have suffered ejection failure. Due to similar reasons to the effects shown in FIGS. 17A and 17B, the nozzle NZ_a and the nozzle NZ_b have the same landing interference pattern as shown in FIG. 7A, and the nozzle NZ_c and the nozzle NZ_d have the same landing interference as shown in FIG. 7B.

In other words, the nozzles which are adjacent before and after the ejection failure nozzles NZ_a and NZ_b (namely, the adjacent to ejection failure nozzles) belong to the nozzle groups c and d (see FIG. 6), and droplets ejected from the adjacent to ejection failure nozzles belonging to these nozzle groups c and d are deposited before the droplets ejected by the nozzle groups a and b. Therefore, landing interference does not occur in the droplets relating to the previous deposition, even if the nozzle NZ_a and the nozzle NZ_b of the nozzle groups a and b which eject droplets subsequently are suffering ejection failure. This state is similar to that shown in FIG. 17B. Consequently, as shown in the right-hand diagram in FIG. 7A, the gap ΔSa between dots formed by droplets ejected by the pair of adjacent to ejection failure nozzles which are adjacent to the ejection failure nozzle NZ_a and the gap ΔSb between dots formed by droplets ejected by the pair of adjacent to ejection failure nozzles which are adjacent to the ejection failure nozzle NZ_b are not affected by increase in error due to landing interference, and these gaps are narrow (ΔSa=ΔSb).

On the other hand, the nozzles which are adjacent before and after the ejection failure nozzles NZ_c and NZ_d (namely, the adjacent to ejection failure nozzles) belong to the nozzle groups a and b, and droplets ejected from the adjacent to ejection failure nozzles belonging to these nozzle groups a and b are deposited after the droplets ejected by the nozzle groups c and d. Therefore, if the nozzle NZ_c and the nozzle NZ_d of the nozzle groups c and d which eject droplets previously are suffering ejection failure, then landing interference occurs in the subsequently ejected droplets. This state is similar to that shown in FIG. 17A. Consequently, as shown in the right-hand diagram in FIG. 7B, the gap ΔSc between dots formed by droplets ejected by the pair of adjacent to ejection failure nozzles which are adjacent to the ejection failure nozzle NZ_c and the gap ΔSd between dots formed by droplets ejected by the pair of adjacent to ejection failure nozzles which are adjacent to the ejection failure nozzle NZ_d are both affected by increase in error due to landing interference, and therefore these gaps are wide (ΔSc=ΔSd>ΔSa).

Therefore, it is possible to divide the landing interference patterns into two types: the landing interference pattern A such as that shown in FIG. 7A and the landing interference pattern B such as that shown in FIG. 7B. By means of the foregoing, the classification of the landing interference patterns is completed.

The nozzles belonging to the nozzle groups a and b are associated with the landing interference pattern A and the nozzles belonging to the nozzle groups c and d are associated with the landing interference pattern B. In this way, correspondence information between the nozzles and the landing interference patterns is obtained.

Subsequently, similarly to the first embodiment, correction LUTs for each landing interference pattern are measured from test charts corresponding to the respective landing interference patterns, and ejection failure is corrected in respect of the actual input image data (see FIG. 1).

Further Embodiments

Modification Example 1

In the first embodiment and the second embodiment, ejection failure correction is carried out by raising the image setting values before and after an ejection failure nozzle. Instead of, or in combination with, the correction of image setting values of this kind, it is also possible to perform ejection failure correction by increasing the dot diameter or raising the droplet ejection density before and after an ejection failure nozzle. Furthermore, in FIG. 1, correction is applied to the image data before the N value conversion processing, but it is also possible to adopt a mode in which correction is applied to image data after the N value conversion processing (image data converted to N values).

Modification Example 2

In the second embodiment, in an example in which nozzles 20 are arranged in a matrix configuration on the head module 50, the landing interference patterns are classified on the basis of the periodicity of the nozzle arrangement. If the nozzle arrangement has another regular pattern (for example, symmetry), then the classification of landing interference patterns can be limited by taking these characteristics into account.

As stated previously, in the correction technology according to embodiments of the present invention, a correction LUT (the ejection failure technology used) for image setting values is determined on the basis of landing interference generating factors peripheral to an ejection failure nozzle (these factors being principally the deposition sequence, position error and dot diameter).

Description of Inkjet Ejection Apparatus

Figure 8:
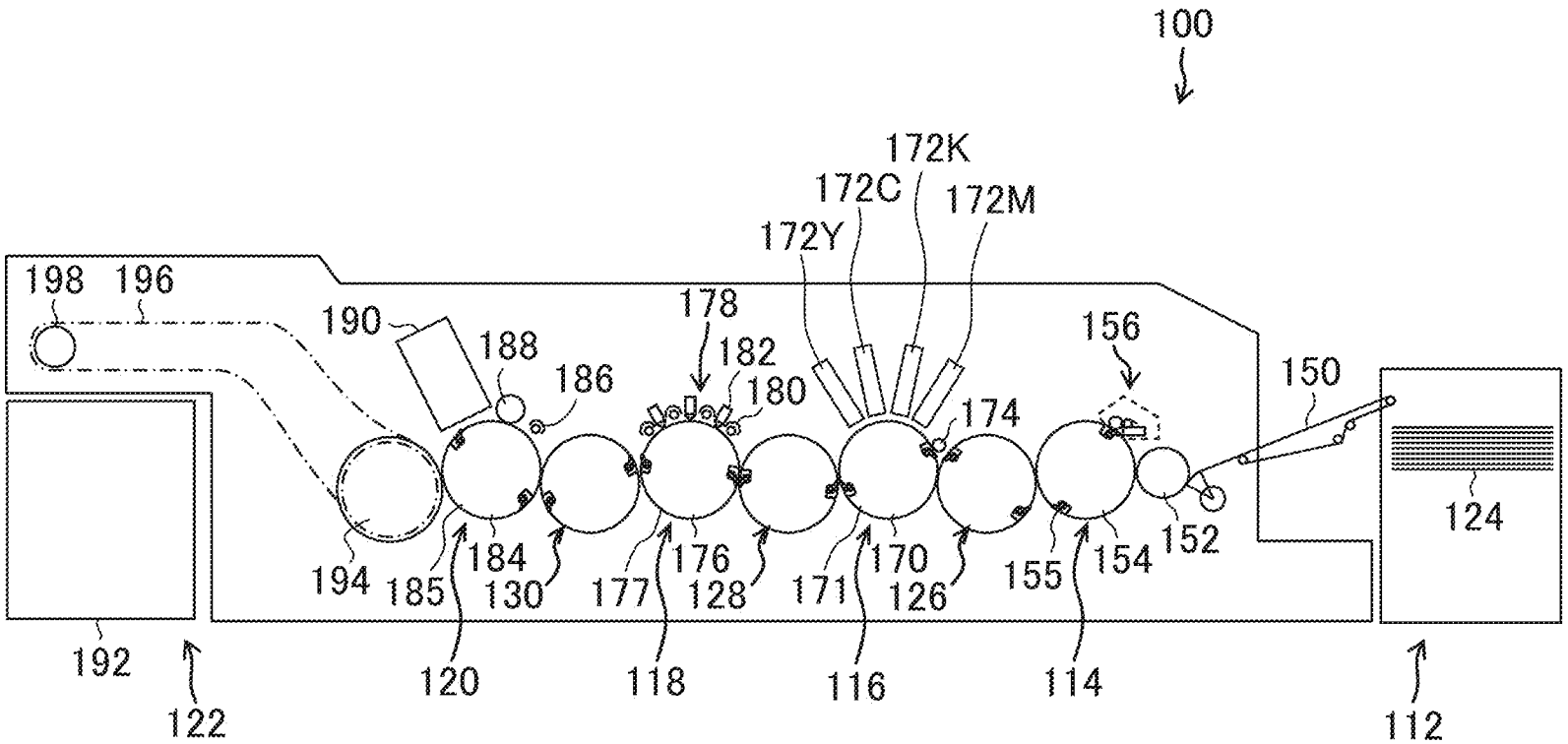
FIG. 8 is a general schematic drawing of an inkjet image forming apparatus relating to an embodiment of the present invention.

FIG. 8 is an example of the composition of an inkjet recording apparatus relating to an embodiment of the present invention. This inkjet recording apparatus 100 (corresponding to an "inkjet image forming apparatus") is an inkjet recording apparatus using a pressure drum direct image formation method which forms a desired color image by ejecting droplets of inks of a plurality of colors from inkjet heads 172M, 172K, 172C and 172Y onto a recording medium 124 (corresponding to a "recording medium"; called "paper" below for the sake of convenience) held on a pressure drum (image formation drum 170) of an image formation unit 116. The inkjet recording apparatus 100 is an image forming apparatus of an on-demand type employing a two-liquid reaction (aggregation) method in which an image is formed on a recording medium 124 by depositing a treatment liquid (here, an aggregating treatment liquid) on a recording medium 124 before ejecting droplets of ink, and causing the treatment liquid and ink liquid to react together.

As shown in FIG. 1, the inkjet recording apparatus 100 principally includes a paper feed unit 112, a treatment liquid deposition unit 114, an image formation unit 116, a drying unit 118, a fixing unit 120 and a paper output unit 122.

Paper Supply Unit

The paper supply unit 112 is a mechanism for supplying a recording medium 124 to the treatment liquid deposition unit 114, and a recording medium 124 which is cut sheet paper is stacked in the paper supply unit 112. A paper supply tray 150 is provided with the paper supply unit 112, and the recording medium 124 is supplied one sheet at a time to the treatment liquid deposition unit 114 from the paper supply tray 150.

In the inkjet recording apparatus 100 according to the present example, it is possible to use recording media 124 of a plurality of types having different materials and dimensions (paper size) as the recording medium 124. It is also possible to use a mode in which a plurality of paper trays (not illustrated) for respectively and separately stacking recording media of different types are provided in the paper supply unit 112, and the paper supplied from the paper supply tray 150 among this plurality of paper trays is switched automatically, or a mode in which the operator selects the paper tray or replaces the paper tray according to requirements. In the present embodiment, cut sheet paper (cut paper) is used as the recording medium 124, but it is also possible to adopt a composition in which paper is supplied from a continuous roll (rolled paper) and is cut to the required size.

Treatment Liquid Deposition Unit

The treatment liquid deposition unit 114 is a mechanism which deposits treatment liquid onto a recording surface of the recording medium 124. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

As shown in FIG. 8, the treatment liquid deposition unit 114 includes a paper supply drum 152, a treatment liquid drum 154 and a treatment liquid application apparatus 156. The treatment liquid drum 154 is a drum which holds the recording medium 124 and conveys the medium so as to rotate. The treatment liquid drum 154 includes a hook-shaped gripping device (gripper) 155 provided on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 tightly against the circumferential surface of the treatment liquid drum 154.

A treatment liquid application apparatus 156 is provided opposing the circumferential surface of the treatment liquid drum 154, to the outside of the drum 154. The treatment liquid application apparatus 156 includes a treatment liquid vessel in which treatment liquid is stored, an anilox roller which is partially immersed in the treatment liquid in the treatment liquid vessel, and a rubber roller which transfers a dosed amount of the treatment liquid to the recording medium 124, by being pressed against the anilox roller and the recording medium 124 on the treatment liquid drum 154. According to this treatment liquid application apparatus 156, it is possible to apply treatment liquid to the recording medium 124 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 124 onto which the treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 includes an image formation drum 170, a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum. The recording medium 124 held on the image formation drum 170 is conveyed with the recording surface thereof facing to the outer side, and ink is deposited onto this recording surface from the inkjet heads 172M, 172K, 172C and 172Y.

The inkjet heads 172M, 172K, 172C and 172Y are respectively full-line type inkjet recording heads (inkjet heads) having a length corresponding to the maximum width of the image forming region on the recording medium 124, and a nozzle row of nozzles for ejecting ink arranged throughout the whole width of the image forming region is formed in the ink ejection surface of each head. The inkjet heads 172M, 172K, 172C and 172Y are disposed so as to extend in a direction perpendicular to the conveyance direction of the recording medium 124 (the direction of rotation of the image formation drum 170).

When droplets of the corresponding colored ink are ejected from the inkjet heads 172M, 172K, 172C and 172Y toward the recording surface of the recording medium 124 which is held tightly on the image formation drum 170, the ink makes contact with the treatment liquid which has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

In other words, the recording medium 124 is conveyed at a uniform speed by the image formation drum 170, and it is possible to record an image on an image forming region of the recording medium 124 by performing just one operation of moving the recording medium 124 and the respective ink heads 172M, 172K, 172C and 172Y relatively in the conveyance direction (namely, by a single sub-scanning operation). Forming an image by a single pass method using a full line type (page-wide) head of this kind enables high-speed printing compared to a case of using a multiple-pass method employing a serial (shuttle) type head which moves back and forth in a direction (the main scanning direction) which is perpendicular to the conveyance direction of the recording medium (the sub-scanning direction), and therefore printing productivity can be improved. The inkjet recording apparatus 100 according to the present embodiment is able to record onto recording media (recording paper) up to a maximum of half Kiku size, for example, and uses a drum having a diameter of approximately 500 mm which corresponds to a recording medium width of 720 mm, for example, as the image formation drum 170. Furthermore, the ink ejection volume from the inkjet heads 172M, 172K, 172C and 172Y is 2 pl, for example, and the recording density is 1200 dpi, for example, in both the main scanning direction (the width direction of the recording medium 124) and the sub-scanning direction (the conveyance direction of the recording medium 124).

Although the configuration with the CMYK four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The recording medium 124 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which dries the water content contained in the solvent which has been separated by the action of aggregating the coloring material, and as shown in FIG. 8, includes a drying drum 176 and a solvent drying apparatus 178.

Similarly to the treatment liquid drum 154, the drying drum 176 includes a hook-shaped holding device (gripper) 177 provided on the outer circumferential surface of the drum, in such a manner that the leading end of the recording medium 124 can be held by the holding device 177.

The solvent drying apparatus 178 is disposed in a position opposing the outer circumferential surface of the drying drum 176, and is constituted by a plurality of halogen heaters 180 and hot air spraying nozzles 182 disposed respectively between the halogen heaters 180.

It is possible to achieve various drying conditions, by suitably adjusting the temperature and air flow volume of the hot air flow which is blown from the hot air flow spraying nozzles 182 toward the recording medium 124, and the temperatures of the respective halogen heaters 180.

Furthermore, the surface temperature of the drying drum 176 is set to not less than 50° C. By heating from the rear surface of the recording medium 124, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176, desirably, the surface temperature of the drying drum 76 is not more than 75° C. (and more desirably, not more than 60° C.).

By holding the recording medium 124 in such a manner that the recording surface thereof is facing outwards on the outer circumferential surface of the drying drum 176 (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

The recording medium 124 on which a drying process has been carried out in the drying unit 118 is transferred from the drying drum 176 to the fixing drum 184 of the fixing to unit 120 via the intermediate conveyance unit 130.

Fixing Unit

The fixing unit 120 includes a fixing drum 184, a halogen heater 186, a fixing roller 188 and an in-line sensor 190. Similarly to the treatment liquid drum 154, the fixing drum 184 includes a hook-shaped holding device (gripper) 185 provided on the outer circumferential surface of the drum, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The halogen heater 186 is controlled to a prescribed temperature (for example, 180° C.). By this means, preliminary heating of the recording medium 124 is carried out.

The fixing roller 188 is a roller member for melting self-dispersing polymer micro-particles contained in the ink and thereby causing the ink to form a film, by applying heat and pressure to the dried ink, and is composed so as to heat and pressurize the recording medium 124. More specifically, the fixing roller 188 is disposed so as to press against the fixing drum 184, in such a manner that a nip is created between the fixing roller and the fixing drum 184. By this means, the recording medium 124 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller in which a halogen lamp is internally incorporated in a metal pipe of aluminum, or the like, having good thermal conductivity, and is controlled to a prescribed temperature (for example, 60° C. to 80° C.). By heating the recording medium 124 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 124, as well as leveling the undulations in the image surface and obtaining a glossy finish.

In the embodiment shown in FIG. 8, only one fixing roller 188 is provided, but it is also possible to provide fixing rollers in a plurality of stages, in accordance with the thickness of the image layer and the Tg characteristics of the latex particles.

On the other hand, the in-line sensor 190 is a measurement device for measuring an ejection defect checking pattern, the image density and image defects, and the like, in an image (including a test pattern, and the like) which has been formed on the recording medium 124; a CCD line sensor, or the like, is employed for the in-line sensor 190.

According to the fixing unit 120 having the composition described above, the latex particles in the thin image layer formed by the drying unit 118 are heated, pressurized and melted by the fixing roller 188, and hence the image layer can be fixed to the recording medium 124. Furthermore, the surface temperature of the fixing drum 184 is set to not less than 50° C. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to include a monomer which can be polymerized and cured by exposure to UV light. In this case, the inkjet recording apparatus 100 includes a UV exposure unit for exposing the ink on the recording medium 124 to UV light, instead of a heat and pressure fixing unit (fixing roller 188) based on a heat roller. In this way, if using an ink containing an active light-curable resin, such as an ultraviolet-curable resin, a device which irradiates the active light, such as a UV lamp or an ultraviolet LD (laser diode) array, is provided instead of the fixing roller 188 for heat fixing.

Paper Output Unit

As shown in FIG. 8, a paper output unit 122 is provided subsequently to the fixing unit 120. The paper output unit 122 includes an output tray 192, and a transfer drum 194, a conveyance belt 196 and a tensioning roller 198 are provided between the output tray 192 and the fixing drum 184 of the fixing unit 120 so as to oppose same. The recording medium 124 is sent to the conveyance belt 196 by the transfer drum 194 and output to the output tray 192. The details of the paper conveyance mechanism created by the conveyance belt 196 are not shown, but the leading end portion of a recording medium 124 after printing is held by a gripper of a bar (not illustrated) which spans across the endless conveyance belt 196, and the recording medium is conveyed above the output tray 192 due to the rotation of the conveyance belt 196.

Furthermore, although not shown in FIG. 8, the inkjet recording apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, a temperature sensor which determines the temperature of the respective units of the apparatus, and the like.

Structure of the Head

Next, the structure of a head will be described. The heads 172M, 172K, 172C and 172Y have the same structure, and a reference numeral 250 is hereinafter designated to any of the heads.

Figure 9A:
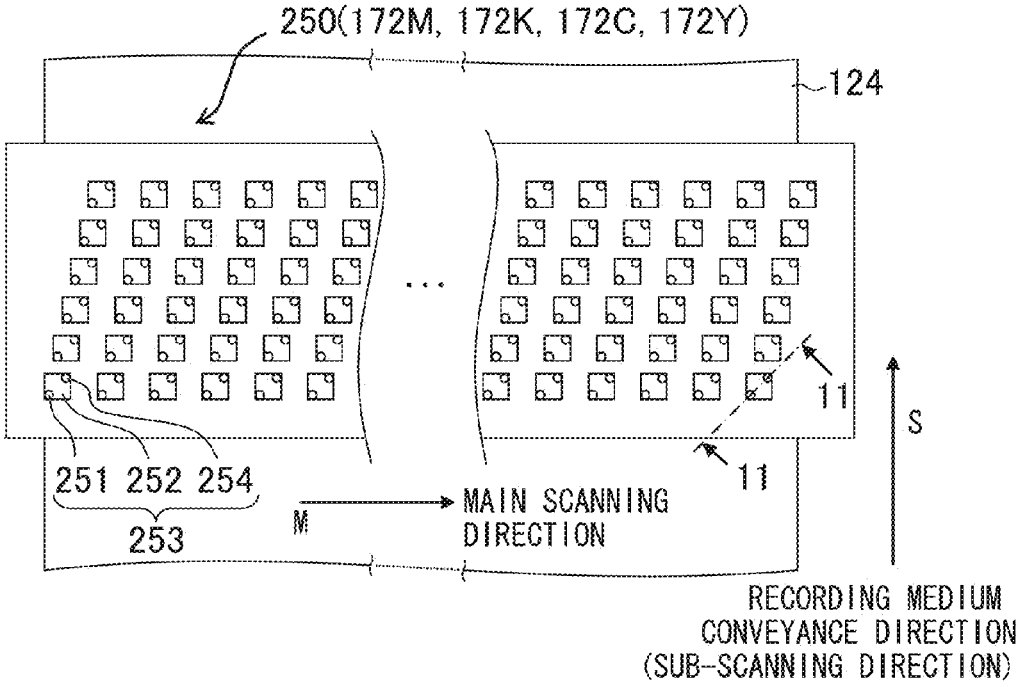
FIGS. 9A and 9B are plan view perspective diagrams showing an example of the composition of an inkjet head.
Figure 9B:
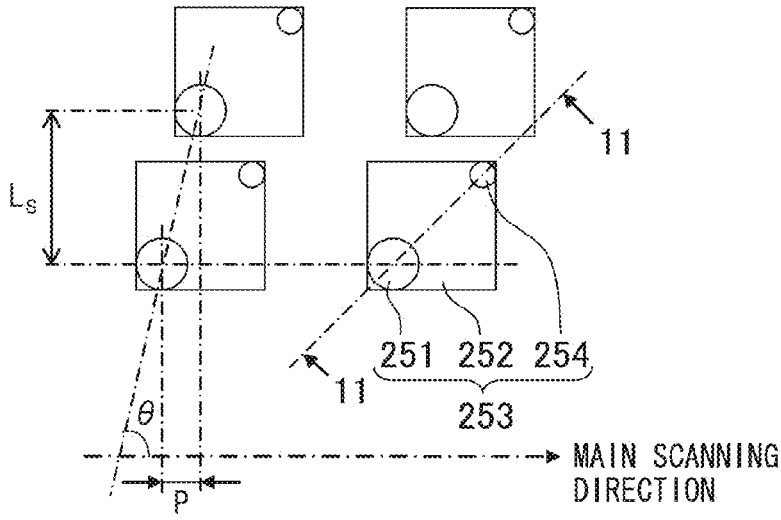
Figure 10A:
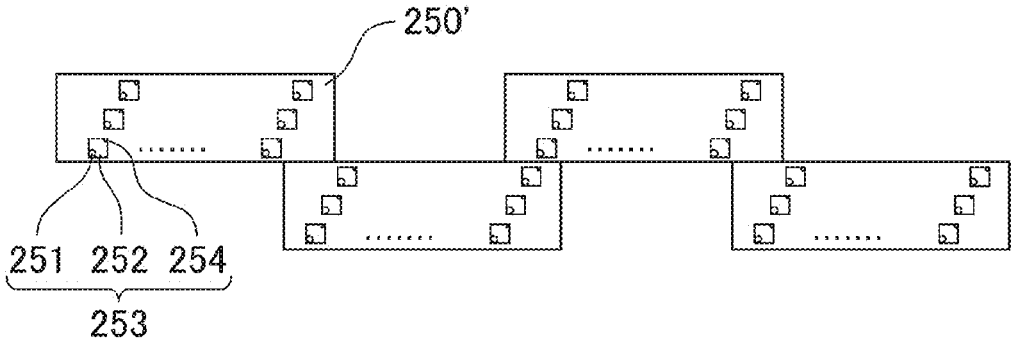
FIGS. 10A and 10B are diagrams showing examples of an inkjet head composed by joining together a plurality of head modules.
Figure 10B:
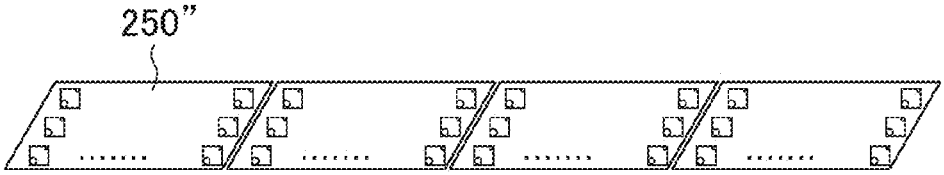
Figure 11:
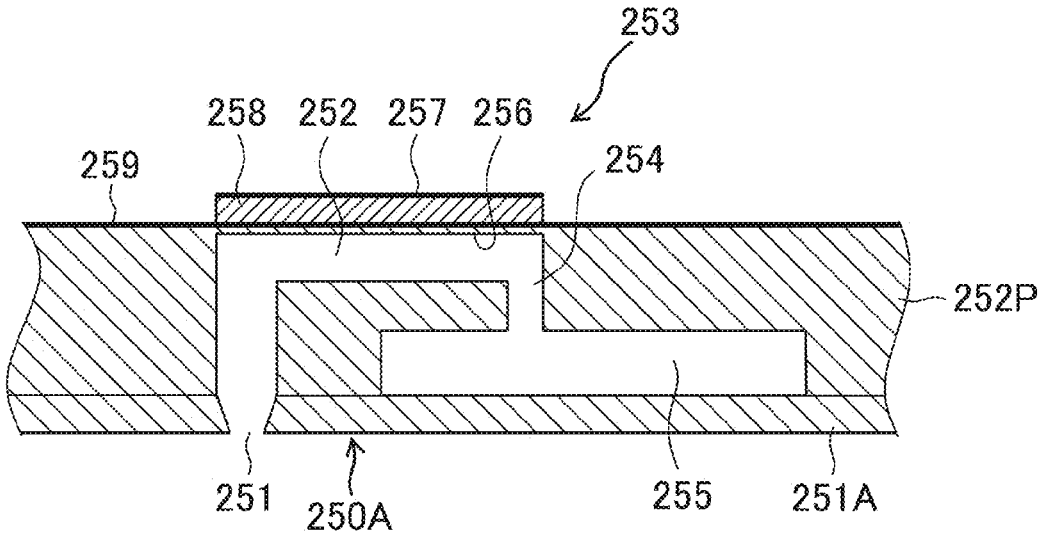
FIG. 11 is a cross-sectional diagram along line 11-11 in FIGS. 9A and 9B.

FIG. 9A is a perspective plan view showing an example of the configuration of the head 250, FIG. 9B is an enlarged view of a portion thereof, FIGS. 10A and 10B are perspective plan views showing other examples of the configuration of the head 250, and FIG. 11 is a cross-sectional view taken along the line 11-11 in FIGS. 9A and 9B, showing the structure of a droplet ejection element (an ink chamber unit for one nozzle 251) corresponding to one channel serving as a recording element unit.

As shown in FIGS. 9A and 9B, the head 250 according to the present embodiment has a structure in which a plurality of ink chamber units (droplet ejection elements) 253, each comprising a nozzle 251 forming an ink ejection port, a pressure chamber 252 corresponding to the nozzle 251, and the like, are disposed two-dimensionally in the form of a matrix, and hence the effective nozzle interval (the projected nozzle pitch) as projected (orthogonally projected) in the lengthwise direction of the head (the direction perpendicular to the paper conveyance direction) is reduced and high nozzle density is achieved.

The mode of composing a nozzle row having a length equal to or greater than the full width Wm of the image formation region of the recording medium 124 in a direction (the main scanning direction, the direction indicated by arrow M) which is substantially perpendicular to the feed direction of the recording medium 114 (the sub-scanning direction, the direction of arrow S) is not limited to the present example. For example, instead of the composition in FIG. 9A, it is possible to adopt a mode in which a line head having a nozzle row of a length corresponding to the full width of the recording medium 124 is composed by joining together in a staggered configuration short head modules 250' in which a plurality of nozzles 251 are arranged in a two-dimensional arrangement, as shown in FIG. 10A, or a mode in which head modules 250" are joined together in an alignment in one row as shown in FIG. 10B.

The pressure chambers 252 provided to correspond to the respective nozzles 251 have a substantially square planar shape (see FIGS. 9A and 9B), an outlet port to the nozzle 251 being provided in one corner of a diagonal of the pressure chamber, and an ink inlet port (supply port) 254 being provided in the other corner thereof. The shape of the pressure chamber 252 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 11, the head 250 has a structure in which a nozzle plate 251A in which the nozzles 251 are formed, a flow channel plate 252P in which flow channels such as the pressure chambers 252 and a common flow channel 255, and the like, are formed, and so on, are layered and bonded together. The nozzle plate 251A constitutes the nozzle surface (ink ejection surface) 250A of the head 250 and the plurality of nozzles 251 which are connected respectively to the pressure chambers 252 are formed in a two-dimensional configuration therein.

The flow channel plate 252P is a flow channel forming member which constitutes side wall portions of the pressure chambers 252 and in which a supply port 254 is formed to serve as a restricting section (most constricted portion) of an individual supply channel for guiding ink to each pressure chamber 252 from the common flow channel 255. For the sake of the description, a simplified view is given in FIG. 11, but the flow channel plate 252P has a structure formed by layering together one or a plurality of substrates.

The nozzle plate 251A and the flow channel plate 252P can be processed into a required shape by a semi-conductor manufacturing process using silicon as a material.

The common flow channel 255 is connected to an ink tank (not shown), which is a base tank that supplies ink, and the ink supplied from the ink tank is supplied through the common flow channel 255 to the pressure chambers 252.

Piezoelectric actuators 258 each including an individual electrode 257 are bonded to a diaphragm 256 which constitutes a portion of the surfaces of the pressure chambers 252 (the ceiling surface in FIG. 11). The diaphragm 256 according to the present embodiment is made of silicon (Si) having a nickel (Ni) conducting layer which functions as a common electrode 259 corresponding to the lower electrode of the piezoelectric actuators 258, and serves as a common electrode for the piezoelectric actuators 258 which are arranged so as to correspond to the respective pressure chambers 252. A mode is also possible in which the diaphragm is made from a non-conductive material, such as resin, and in this mode, a common electrode layer made of a conductive material, such as metal, is formed on the surface of the diaphragm material. Furthermore, the diaphragm which also serves as a common electrode may be made of a metal (conductive material), such as stainless steel (SUS), or the like.

When a drive voltage is applied to an individual electrode 257, the corresponding piezoelectric actuator 258 deforms, thereby changing the volume of the pressure chamber 252. This causes a pressure change which results in ink being ejected from the nozzle 251. When the piezoelectric actuator 258 returns to its original position after ejecting ink, the pressure chamber 252 is replenished with new ink from the common flow channel 255 via the supply port 254.

As shown in FIG. 9B, the high-density nozzle head according to the present embodiment is achieved by arranging a plurality of ink chamber units 253 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction. In such a matrix arrangement, when the pitch of the adjacent nozzles in the sub-scanning direction is represented as Ls, the nozzle pitch in the main-scanning direction is substantially equivalent to that of the configuration in which the nozzles 251 are linearly arranged at uniform pitch P (=Ls/tan θ).

Furthermore, in implementing the present invention, the mode of arrangement of the nozzles 251 in the head 250 is not limited to the example shown in the drawings, and it is possible to adopt various nozzle arrangements. For example, instead of the matrix arrangement shown in FIGS. 9A and 9B, it is possible to use a single row linear arrangement, or a bent line-shaped nozzle arrangement, such as a V-shaped nozzle arrangement, or a zigzag shape (W shape, or the like) in which a V-shaped nozzle arrangement is repeated.

The device for generating ejection pressure (ejection energy) for ejecting droplets from the nozzles in the inkjet head is not limited to a piezoelectric actuator (piezoelectric element), and it is also possible to employ pressure generating elements (energy generating elements) of various types, such as a heater (heating element) in a thermal method (a method which ejects ink by using the pressure created by film boiling upon heating by a heater) or actuators of various kinds based on other methods. A corresponding energy generating element is provided in the flow channel structure in accordance with the ejection method of the head.

Description of Control System

Figure 12:
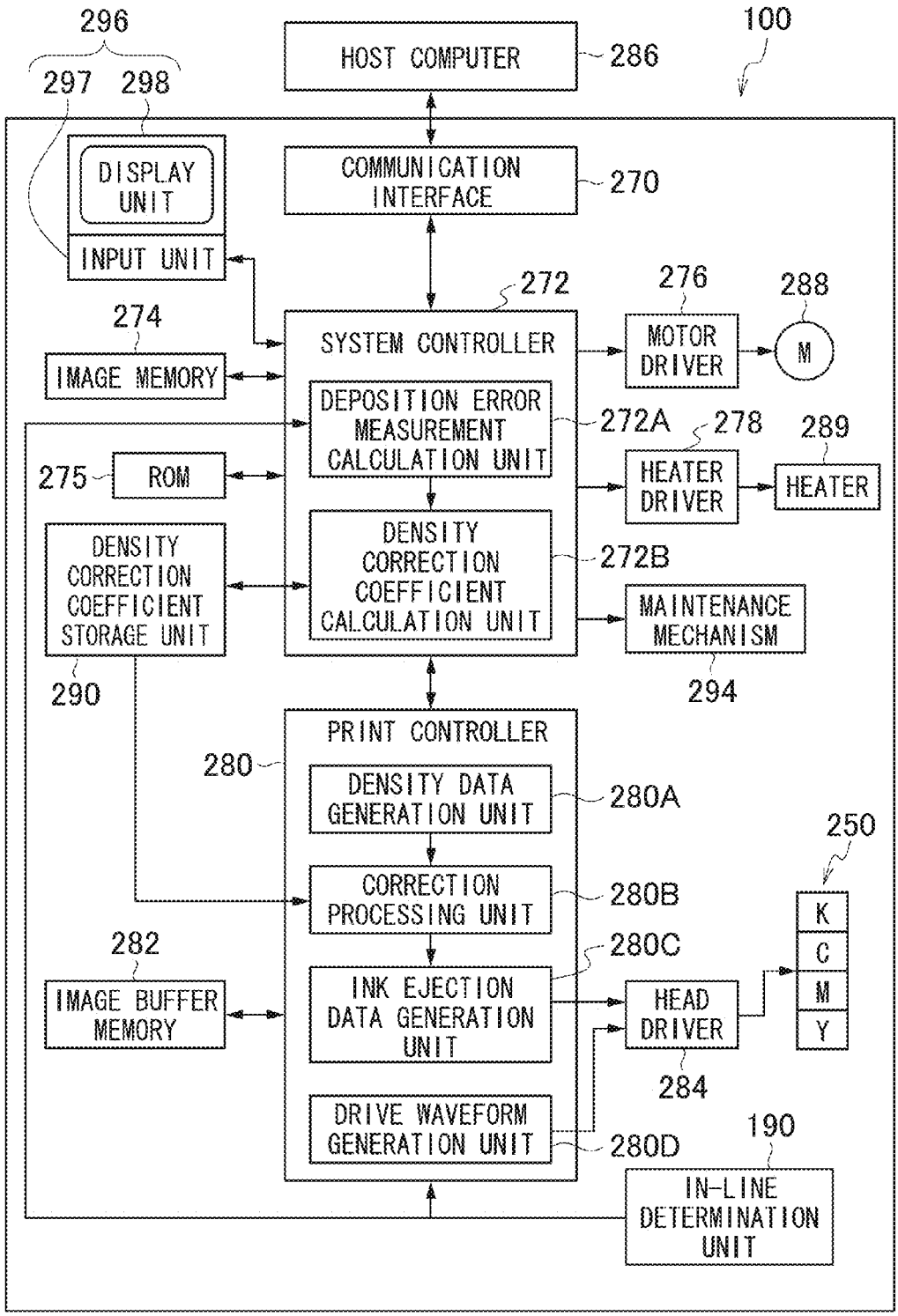
FIG. 12 is a block diagram showing the composition of a control system of an inkjet image forming apparatus.

FIG. 12 is a block diagram showing the system configuration of the inkjet recording apparatus 100. As shown in FIG. 12, the inkjet recording apparatus 100 comprises a communication interface 270, a system controller 272, an image memory 274, a ROM 275, a motor driver 276, a heater driver 278, a print controller 280, an image buffer memory 282, a head driver 284, and the like.

The communication interface 270 is an interface unit (image input device) for receiving image data sent from a host computer 286. A serial interface such as USB (Universal Serial Bus), IEEE1394, Ethernet (registered trademark), wireless network, or a parallel interface such as a Centronics interface may be used as the communication interface 270. A buffer memory (not shown) may be mounted in this portion in order to increase the communication speed.

The image data sent from the host computer 286 is received by the inkjet recording apparatus 100 through the communication interface 270, and is temporarily stored in the image memory 274. The image memory 274 is a storage device for storing images inputted through the communication interface 270, and data is written and read to and from the image memory 274 through the system controller 272. The image memory 274 is not limited to a memory composed of semiconductor elements, and a hard disk drive or another magnetic medium may be used.

The system controller 272 is constituted by a central processing unit (CPU) and peripheral circuits thereof, and the like, and it functions as a control device for controlling the whole of the inkjet recording apparatus 100 in accordance with a prescribed program, as well as a calculation device for performing various calculations. More specifically, the system controller 272 controls the various sections, such as the communication interface 270, image memory 274, motor driver 276, heater driver 278, and the like, as well as controlling communications with the host computer 286 and writing and reading to and from the image memory 274 and ROM 275, and it also generates control signals for controlling the motor 288 of the conveyance system and the heater 289.

Furthermore, the system controller 272 includes: a depositing error measurement calculation unit 272A which performs calculation processing for generating data about the position and depositing position error of ejection failure nozzles and data indicating the density distribution (density data), and the like, from read data of the test chart read in by the in-line sensor (in-line detection unit) 190; and a density correction coefficient calculation unit 272B which calculates a density correction coefficient from the information about the depositing position error and the density information thus measured. The processing functions of the depositing error measurement calculation unit 272A and the density correction coefficient calculation unit 272B can be executed by an ASIC or software, or a suitable combination thereof.

The data about the density correction coefficient determined by the density correction coefficient calculation unit 272B is stored in the density correction coefficient storage unit 290.

Programs and various types of data required for control purposes (data for ejecting droplets to form a test chart, waveform data for detecting abnormal nozzles, waveform data for image recording, abnormal nozzle information, and the like) to be executed by the CPU of the system controller 272 are stored in the ROM 275. The ROM 275 may be a non-rewriteable storage device, or may be a rewriteable storage device such as an EEPROM. Furthermore, it is also possible to compose the ROM 275 so as to serve as the density correction coefficient storage unit 290, by utilizing the storage area of the ROM 275.

The image memory 274 is used as a temporary storage region for the image data, and it is also used as a program development region and a calculation work region for the CPU.

The motor driver 276 is a driver (drive circuit) for driving the motor 288 of the conveyance system in accordance with commands from the system controller 272. The heater driver (drive circuit) 278 drives the heater 289 of the drying unit 118, and the like, in accordance with commands from the system controller 272.

The print controller 280 functions as a signal processing device which performs various processing and correction to generate a signal for controlling droplet ejection from the image data (multiple-value input image data) in the image memory 274, in accordance with control implemented by the system controller 272, as well as functioning as a drive control device which controls the driving of ejection from the head 250 by supplying the generated ink ejection data to the head driver 284.

More specifically, the print controller 280 includes a density data generation unit 280A, a correction processing unit 280B, an ink ejection data generation unit 280C and a drive waveform generation unit 280D. These respective functional blocks (280A to 280D) can be implemented by an ASIC, software or a suitable combination thereof.

The density data generation unit 280A is a signal processing device which generates initial density data for each ink color from input image data, and carries out density conversion processing (including UCR processing and color conversion), and when required, carries out pixel number conversion processing.

The correction processing unit 280B is a processing device which carries out calculation for density correction using a density correction coefficient stored in the density correction coefficient storage unit 290, and thereby performs non-uniformity correction processing. This correction processing unit 280B performs the ejection failure correction processing described in relation to FIG. 1.

The ink ejection data generation unit 280C is a signal processing device including a half-toning device which converts the corrected image data (density data) generated by the correction processing unit 280B into binary or multiple-value dot data (which corresponds to the "N value image data" shown in FIG. 1), and this unit 280C carries out binarization (multiple-value conversion) processing.

The ink ejection data generated in the ink ejection data generation unit 280C is supplied to the head driver 284 and the ink ejection operation of the head 250 is controlled accordingly.

The drive waveform generation unit 280D is a device which generates a drive signal waveform for driving the piezoelectric actuators 258 (see FIG. 11) corresponding to the respective nozzles 251 of the head 250, and the signal (drive waveform) generated by the drive waveform generation unit 280D is supplied to the head driver 284. The signal output from the drive waveform generation unit 280D may be digital waveform data or an analog voltage signal.

The drive waveform generation unit 280D selectively generates a drive signal for a recording waveform and a drive signal for an abnormal nozzle detection waveform. Waveform data of various types is stored previously in the ROM 275 and the waveform used is outputted selectively in accordance with requirements. The inkjet recording apparatus 100 shown in the present embodiment employs a drive method in which a common drive power waveform signal is applied to each of the piezoelectric actuators 258 of the head 250, and ink is ejected from the nozzles 251 corresponding to the respective piezoelectric actuators 258 by turning switching elements (not illustrated) connected to the individual electrodes of the respective piezoelectric actuators 258 on and off, in accordance with the ejection timing of the respective piezoelectric actuators 258.

An image buffer memory 282 is provided with the print controller 280, and data such as image data and parameters, is stored temporarily in the image buffer memory 282 during processing of the image data in the print controller 280. In FIG. 12, the image buffer memory 282 is depicted as being attached to the print controller 280, but may also serve as the image memory 274. Furthermore, also possible is a mode in which the print controller 280 and the system controller 272 are integrated to form a single processor.

To give a general description of the processing from image input until print output, the image data that is to be printed is input via the communication interface 270 from an external source and is collected in the image memory 274. At this stage, for example, RGB multiple-value image data is stored in the image memory 274.

In the inkjet recording apparatus 100, an image having tones which appear continuous to the human eye is formed by altering the droplet ejection density or dot size of fine dots of ink (coloring material), and therefore it is necessary to convert the tones of the input digital image (light/dark density of the image) into a dot pattern which reproduces the tones as faithfully as possible. Therefore, original image (RGB) data collected in the image memory 274 is sent to the print controller 280 via the system controller 272 and is converted into dot data for each of the ink colors by passing through the density data generation unit 280A, the correction processing unit 280B and the ink ejection data generation unit 280C of the print controller 280.

In general, the dot data is generated by subjecting the image data to color conversion processing and halftone processing. The color conversion processing is processing for converting image data represented based on sRGB or the like (for example, 8-bit RGB image data) into color data for each of the colors of ink used by the inkjet printer (KCMY color data, in the present embodiment).

Half-tone processing is processing for converting the color data of the respective colors generated by the color conversion processing, into dot data of respective colors (in the present embodiment, KCMY dot data) by error diffusion or a threshold matrix method, or the like.

In other words, the print controller 280 carries out processing for converting the input RGB image data into dot data for the four colors of K, C, M and Y. In this conversion to dot data, ejection failure correction processing is carried out as described in FIG. 1.

In this way, dot data generated by the print controller 280 is stored in the image buffer memory 282. This color-specific dot data is converted into CMYK droplet ejection data for ejecting inks from the nozzles of the heads 250, thereby establishing ink ejection data which is to be printed.

The head driver 284 includes an amplifier circuit, and outputs a drive signal for driving the piezoelectric actuators 258 corresponding to the respective nozzles 251 of the head 250 in accordance with the print contents, on the basis of the ink ejection data and drive waveform signal supplied from the print controller 280. The head driver 284 may also include a feedback control system for maintaining uniform drive conditions in the heads.

By applying a drive signal output from the head driver 284 to the heads 250 in this way, ink is ejected from the corresponding nozzles 251. An image is formed on a recording medium 124 by controlling ink ejection from the heads 250 in synchronism with the conveyance speed of the recording medium 124.

As described above, the ink droplet ejection volume and the ejection timing from the respective nozzles are controlled via the head driver 284 on the basis of the ink ejection data and the drive signal waveform generated by required signal processing in the print controller 280. By this means, a desired dot size and a desired dot arrangement are achieved.

The in-line sensor (determination unit) 190 is a block that includes an image sensor as described above with reference to FIG. 8, reads an image printed on the recording medium 124, determines the print conditions (presence of the ejection, variation in the droplet ejection, optical density and the like) by performing required signal processing, and the like, and provides the determination results of the print conditions to the print controller 280 and the system controller 272.

The print controller 280 performs various corrections in relation to the heads 250 on the basis of information obtained from the in-line sensor (determination unit) 190 in accordance with requirements, as well as implementing control to perform cleaning operations (nozzle restoration operations), such as preliminary ejection, suctioning, wiping, and the like, in accordance with requirements.

The maintenance mechanism 294 in the drawing includes members required for head maintenance, such as an ink receptacle, a suction cap, a suction pump, a wiper blade, and the like.

The operating unit 296 forming a user interface includes an input unit 297 for the operator (user) to make various inputs and a display unit (display) 298. The input unit 297 may employ various modes, such as a keyboard, mouse, touch panel, buttons, or the like. By operating the input unit 297, an operator can perform actions such as inputting print conditions, selection the image quality mode, inputting and editing additional information, searching for information, and the like, and can confirm various information such as input content, search results, and the like, via the display on the display unit 298. This display unit 298 also functions as a device which displays warnings, such as error messages.

Furthermore, a combination of the system controller 272 and the print controller 280 corresponds to a "droplet ejection control device", a "correction processing device" and a "recording ejection control device". The density correction coefficient storage unit 29 corresponds to a "correction coefficient storage device", and the in-line sensor 190 and the deposition error measurement calculation unit 272A which processes the signal from the sensor correspond to an "ejection failure nozzle position information acquisition device".

It is also possible to adopt a mode in which the host computer 286 is equipped with all or a portion of the processing functions carried out by the depositing error measurement and calculation unit 272A, the density correction coefficient calculation unit 272B, the density data generation unit 280A and the correction processing unit 280B shown in FIG. 12.

Recording Medium

The "recording medium" is a general terms for a medium on which dots are recorded by droplets ejected from the nozzles, and this includes various terms, such as print medium, recording medium, image forming medium, image receiving medium, ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, a printed substrate on which a wiring pattern, or the like, is formed, or a rubber sheet.

Device for Causing Relative Movement of Head and Paper

In the embodiment described above, an example is given in which a recording medium is conveyed with respect to a stationary head, but in implementing the present invention, it is also possible to move the head with respect to the stationary recording medium. A full line type recording head based on a single pass method is normally arranged in a direction perpendicular to the feed direction of the recording medium (conveyance direction), but a mode is also possible in which a head is arranged in an oblique direction forming a certain prescribed angle with respect to the direction perpendicular to the conveyance direction.

Application Examples of the Present Invention

In the embodiments described above, application to an inkjet recording apparatus for graphic printing is described, but the scope of application of the present invention is not limited to this example. For example, the present invention can also be applied widely to inkjet systems which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image processing method of creating image data for forming an image on a recording medium by ejecting liquid droplets from a plurality of nozzles of a recording head onto the recording medium while causing relative movement of the recording medium and the recording head, the image processing method comprising:

a correction coefficient storage step of determining correction coefficients for ejection failure correction based on difference of landing interference patterns of a plurality of types, according to correspondence information indicating correspondence relationship between the landing interference patterns and the respective nozzles, the landing interference patterns being based on a landing interference inducing factor including a deposition sequence of the liquid droplets on the recording medium that is defined by an arrangement configuration of the plurality of nozzles and a direction of the relative movement, and storing the correction coefficients for ejection failure correction according to the landing interference patterns, in a storage unit;

an ejection failure nozzle position information acquisition step of acquiring ejection failure nozzle position information indicating a position of an ejection failure nozzle which cannot be used for forming the image, of the plurality of nozzles; and a correction processing step of performing a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle.

2. The image processing method as defined in claim 1, wherein the landing interference patterns are determined according to an amount of change in a droplet ejection pitch on the recording medium between liquid droplets ejected from two nozzles capable of forming dots at adjacent positions on either side of a position on the recording medium where droplet ejection by the ejection failure nozzle cannot be performed.

3. The image processing method as defined in claim 1, wherein the amount of change varies depending on a droplet ejection sequence of nozzles other than the ejection failure nozzle.

4. The image processing method as defined in claim 1, wherein the landing interference patterns are determined further according to at least one information element of dot size formed by the liquid droplets and a depositing position error of the liquid droplets.

5. The image processing method as defined in claim 1, wherein in the correction processing step, the correction calculation using the corresponding correction coefficient is performed on pixel information of an image prior to half-tone processing.

6. The image processing method as defined in claim 1, wherein in the correction processing step, the image data is corrected in such a manner that the output of the ejection failure nozzle is compensated by changing dot size formed by a liquid droplet ejected from a nozzle peripheral to the ejection failure nozzle according to the ejection failure nozzle position information.

7. The image processing method as defined in claim 1, wherein the correspondence relationship between the landing interference patterns and the respective nozzles is classified into a plurality of groups, according to periodicity of nozzle arrangement in the arrangement configuration of the plurality of nozzles.

8. The image processing method as defined in claim 7, wherein the correspondence relationship between the landing interference patterns and the respective nozzles is classified into the plurality of groups, according to a symmetry property of the nozzle arrangement in the arrangement configuration of the plurality of nozzles, in addition to the periodicity.

9. An image processing apparatus for creating image data for forming an image on a recording medium by ejecting liquid droplets from a plurality of nozzles of a recording head onto the recording medium while causing relative movement of the recording medium and the recording head, the image processing apparatus comprising:

a correction coefficient storage device which stores correction coefficients for ejection failure correction based on difference of landing interference patterns of a plurality of types, the correction coefficients being determined according to correspondence information indicating correspondence relationship between the respective nozzles and the landing interference patterns based on a landing interference inducing factor including a deposition sequence of the liquid droplets on the recording medium that is defined by an arrangement configuration of the plurality of nozzles and a direction of the relative movement, the correction coefficients for ejection failure correction being stored according to the landing interference patterns;

an ejection failure nozzle position information acquisition device which acquires ejection failure nozzle position information indicating a position of an ejection failure nozzle which cannot be used for forming the image, of the plurality of nozzles; and a correction processing device which performs a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle.

10. An inkjet image forming apparatus comprising:

a recording head having a plurality of nozzles for ejecting liquid droplets;

a conveyance device which conveys at least one of the recording head and a recording medium so as to cause relative movement of the recording head and the recording medium;

a correction coefficient storage device which stores correction coefficients for ejection failure correction based on difference of landing interference patterns of a plurality of types, the correction coefficients being determined according to correspondence information indicating correspondence relationship between the respective nozzles and the landing interference patterns based on a landing interference inducing factor including a deposition sequence of the liquid droplets on the recording medium that is defined by an arrangement configuration of the plurality of nozzles and a direction of the relative movement, the correction coefficients for ejection failure correction being stored according to the landing interference patterns;

an ejection failure nozzle position information acquisition device which acquires ejection failure nozzle position information indicating a position of an ejection failure nozzle which cannot be used for forming the image, of the plurality of nozzles;

a correction processing device which performs a correction calculation on input image data using a corresponding correction coefficient obtained by referring to the correction coefficients for ejection failure correction according to the ejection failure nozzle position information, so as to generate image data corrected in such a manner that output of the ejection failure nozzle is compensated by a nozzle other than the ejection failure nozzle; and a droplet ejection controller which controls droplet ejection of the recording head according to the image data generated by the correction processing device.

11. The inkjet image forming apparatus as defined in claim 10, further comprising a test chart creation device which creates test charts of a plurality of types corresponding to the respective landing interference patterns, according to the correspondence information, wherein the correction coefficients for ejection failure correction are determined respectively for the landing interference patterns, according to output results of the test charts of the plurality of types created respectively for the landing interference patterns.

12. The inkjet image forming apparatus as defined in claim 10, wherein the correction coefficient storage device stores a look-up table specifying relationship of the correction coefficients with respect to image setting values, according to the landing interference patterns.

13. A correction coefficient data generating method of generating correction coefficient data for ejection failure correction to be used in correction processing for compensating for output of an ejection failure nozzle which cannot be used for image formation, by a nozzle other than the ejection failure nozzle, when the ejection failure nozzle is present in an inkjet image forming apparatus which includes a recording head having a plurality of nozzles for ejecting liquid droplets and deposits the liquid droplets ejected from the plurality of nozzles onto a recording medium while causing relative movement of the recording medium and the recording head so as to form an image on the recording medium, the correction coefficient data generating method comprising:

a test chart forming step of forming test charts of a plurality of types corresponding to landing interference patterns of a plurality of types, by performing an ejection disabling process of artificially disabling liquid ejection in different nozzles corresponding to difference of the landing interference patterns, according to correspondence information indicating correspondence relationship between the respective nozzles and the landing interference patterns based on a landing interference inducing factor which includes a deposition sequence of the liquid droplets on the recording medium that is defined by an arrangement configuration of the plurality of nozzles and a direction of the relative movement;

a correction coefficient determination step of determining correction coefficients for ejection failure correction respectively for the landing interference patterns, from output results of the test charts of the plurality of types created respectively for the landing interference patterns; and a storage step of storing the landing interference patterns and the correction coefficients determined respectively for the landing interference patterns in association with each other in a storage device.

14. The correction coefficient data generating method as defined in claim 13, wherein:

the test charts include a plurality of patches formed by altering the correction coefficient, and a patch that has yielded a best image quality is selected from among the plurality of patches and a correction coefficient used in the formation of that patch is determined as the correction coefficient for ejection failure correction.

* * * * *